US011260549B2

(12) United States Patent
Lap et al.

(10) Patent No.: US 11,260,549 B2
(45) Date of Patent: Mar. 1, 2022

(54) SHAVING UNIT WITH DRIVE SPINDLES EXTENDING IN OPEN SPACE

(71) Applicant: KONINKLIJKE PHILIPS N.V., Eindhoven (NL)

(72) Inventors: Reinder Niels Lap, Surhuizum (NL); Alwin William De Vries, Zuidlaren (NL); Marcus Cornelis Petrelli, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 176 days.

(21) Appl. No.: 16/480,718

(22) PCT Filed: Jan. 25, 2018

(86) PCT No.: PCT/EP2018/051763
§ 371 (c)(1),
(2) Date: Jul. 25, 2019

(87) PCT Pub. No.: WO2018/138172
PCT Pub. Date: Aug. 2, 2018

(65) Prior Publication Data

US 2019/0389084 A1 Dec. 26, 2019

(30) Foreign Application Priority Data

Jan. 27, 2017 (EP) ..... 17153536

(51) Int. Cl.
*B26B 19/14* (2006.01)
*B26B 19/28* (2006.01)
*B26B 19/38* (2006.01)

(52) U.S. Cl.
CPC ..... *B26B 19/145* (2013.01); *B26B 19/146* (2013.01); *B26B 19/28* (2013.01); *B26B 19/386* (2013.01); *B26B 19/3853* (2013.01)

(58) Field of Classification Search
CPC ..... B26B 19/14; B26B 19/145; B26B 19/146; B26B 19/38; B26B 19/382;
(Continued)

(56) References Cited

U.S. PATENT DOCUMENTS 2,167,833 A * 8/1939 Gold ..... B26B 19/26 30/43.5
RE30,857 E * 2/1982 Tyler ..... B26B 19/145 30/43.5
(Continued)

FOREIGN PATENT DOCUMENTS

CN 101683739 3/2010
CN 101683739 A * 3/2010 ..... B26B 19/145
(Continued)

OTHER PUBLICATIONS

CN-101683739-A English Translation; Chang Ming Ye B26B19/145.*
(Continued)

*Primary Examiner* — Laura M Lee

(57) ABSTRACT

A shaver for a shaving apparatus includes at least first and second cutters which respectively have first and second external cutting members with a plurality of hair entry openings which define, respectively, first and second shaving tracks. The cutters each have an internal cutting member which is respectively rotatable relative to the corresponding external cutting member about first and second axis of rotation. The internal cutting members are respectively connected to first and second driven transmission element via first and second drive spindles. The driven transmission elements are included in a transmission unit, where the drive spindles extend from the transmission unit via an open space, which is present between the transmission unit and the cutting units, and respectively pass through an opening
(Continued)

in a bottom wall of a first housing of the first cutting unit and a second housing of the second cutting unit.

18 Claims, 11 Drawing Sheets

(58) Field of Classification Search
CPC ..... B26B 19/3833; B26B 19/3853; B26B 19/3866; B26B 19/28; B26B 19/386
USPC ..... 30/43.4–43.6, 346.51, 41.6
See application file for complete search history.

(56) References Cited

U.S. PATENT DOCUMENTS

| | | | | |
|---|---|---|---|---|
| 6,584,691 | B1 | 7/2003 | Gerasimov | |
| 10,532,474 | B2 * | 1/2020 | Julemont | B26B 19/3853 |
| RE48,352 | E * | 12/2020 | Westerhof | B26B 19/386 |
| 10,933,545 | B2 * | 3/2021 | Lap | B26B 19/38 |
| 11,154,996 | B2 * | 10/2021 | Lap | B26B 19/146 |
| 2006/0156550 | A1 | 7/2006 | Beugels | |
| 2010/0011589 | A1 | 1/2010 | Van Der Borst | |
| 2014/0196292 | A1 | 7/2014 | Schmitt | |
| 2016/0052153 | A1 | 2/2016 | Osterhoff | |
| 2018/0161996 | A1 * | 6/2018 | Julemont | B26B 19/14 |
| 2019/0337171 | A1 * | 11/2019 | Lap | B26B 19/146 |
| 2019/0389084 | A1 * | 12/2019 | Lap | B26B 19/386 |
| 2020/0189133 | A1 * | 6/2020 | Lap | B26B 19/3846 |
| 2021/0308885 | A1 * | 10/2021 | Horowitz | B26B 19/14 |

FOREIGN PATENT DOCUMENTS

| | | | | |
|---|---|---|---|---|
| CN | 101890730 | A * | 11/2010 | |
| CN | 204123414 | | 1/2015 | |
| CN | 105364949 | | 3/2016 | |
| EP | 2086729 | | 8/2009 | |
| WO | 2006/067721 | | 6/2006 | |
| WO | WO-2010034175 | A1 * | 4/2010 | B26B 19/145 |
| WO | 2010/103425 | | 9/2010 | |

OTHER PUBLICATIONS

International Search Report and Written Opinion dated Apr. 26, 2018 for International Application No. PCT/EP2018/051763 Filed Jan. 25, 2018.

* cited by examiner

SHAVING UNIT WITH DRIVE SPINDLES EXTENDING IN OPEN SPACE

CROSS REFERENCE TO RELATED APPLICATIONS

This application is the U.S. National Phase application under 35 U.S.C. § 371 of International Application No. PCT/EP2018/051763 filed Jan. 25, 2018, published as WO 2018/138172 on Aug. 2, 2018, which claims the benefit of European Patent Application Number 17153536.2 filed Jan. 27, 2017. These applications are hereby incorporated by reference herein.

FIELD OF THE INVENTION

The invention relates to a shaving unit, comprising at least a first cutting unit and a second cutting unit.

A further aspect of the invention is a shaving apparatus incorporating such a shaving unit.

BACKGROUND OF THE INVENTION

Shaving units and apparatuses are used for shaving, in particular for shaving a men's skin in the lower facial region and the neck region. In such shaving applications it is a specific task of such shaving units and apparatuses to follow the contour of the skin to reach a good shaving result. Such contour following is particularly difficult in the region of the chin or the lower edge of the jaw.

Generally, shaving apparatuses are known wherein the cutting units are pivotal in relation to the handle of the shaving apparatus such as to improve the ability of the cutting units to follow the contour of the skin. However, such simple pivoting action always results in some sectors or even large sectors of the shaving tracks of the external cutting members of the cutting units being not in contact with the skin. Thus the shaving efficiency is not satisfying.

U.S. Pat. No. 6,584,691B1 discloses an electric shaver with two blades which rotate about their centrelines and at the same time orbit around another axis. The axis and the centrelines are hold in a parallel orientation to each other and thus do not allow a good contour following. Further, cleaning of the shaving head will be difficult since the blades are not easy accessible and sensitive parts of the drive train might be involved and damaged during such cleaning procedure.

CN101683739B discloses a shaving apparatus with three cutting units. Each cutting unit comprises a rotatable blade which is driven by a drive train. The drive train comprises a central drive gear wheel driving to three driven gear wheels which are coupled to the cutters. The cutting units and the drive train are encapsulated by a housing from the environment. Cleaning of the shaver requires the cutting units to be opened since no access is possible otherwise. This opening procedure makes the cleaning cumbersome and complicates the design of the cutting units.

US2006/156550A1 discloses a shaving apparatus with three cutting units. Each cutting unit comprises a rotatable blade which is driven by a drive train. The drive train comprises a central drive gear wheel driving to three driven gear wheels which are coupled to the cutters. The cutting units and the drive train are encapsulated by a housing from the environment. A specific channel for removing cut hair is provided which shall discharge water or air introduced into the cutting units out of the shaving head. By this, a specific additional structure inside the shaving head is provided which increases the manufacturing costs.

WO 2006/067721A1 discloses a shaving apparatus comprising a main housing accommodating a motor, and a shaving unit which is releasably coupled to the main housing by means of a central coupling member. The central coupling member of the shaving unit accommodates a central drive shaft, which is coupled to a motor shaft of the motor in the main housing when the shaving unit is coupled to the main housing. The shaving unit comprises three cutting units, which are each pivotal about an individual pivot axis relative to a central support member of the shaving unit. The cutting units each comprise a housing which accommodates a driven gear wheel coupled to an internal cutting member of the cutting unit. The driven gear wheels of the cutting units are driven by a central gear wheel accommodated in the central support member and coupled to the central drive shaft. To maintain the engagement of the central gear wheel with the driven gear wheels during the pivotal motion of the cutting units relative to the central support member, the pivot axis of each cutting unit coincides with a tangential line between the central gear wheel and the driven gear wheel of the cutting unit. In the configuration of this shaving apparatus the gear wheels and the cutting units are provided as a compact shaving unit of the apparatus having only a single central drive shaft for the three cutting units, which can be easily decoupled from the main housing in order to, for example, exchange the shaving unit by another functional attachment or clean the shaving unit. The configuration also ensures a mechanically stiff torque transmission from the central drive shaft to the internal cutting members. Thus, a reliable design with small losses in the transmission path and a silent transmission of the rotation is provided. However, the design has shown that these advantages are accompanied by a limited range of movement of the cutters for a pivotal movement when following the skin contour and a limited accessibility of the cutters for cleaning them and removing cut hair.

SUMMARY OF THE INVENTION

It is an object of the invention to provide a shaving unit and a shaving apparatus incorporating such a shaving unit, wherein the releasable shaving unit has a single central drive shaft that can be releasably coupled to the motor shaft of the motor in the main housing to provide an easy detachment and attachment of the shaving unit from and to the main housing and to provide an easy accessibility of the shaving unit for cleaning the cutting units from cut hair, while at the same time providing a reliant and resilient torque transmission to the cutting units and an improved capability of the cutting units to follow the skin contours.

This object is achieved by a shaving unit for a shaving apparatus, comprising at least a first cutting unit and a second cutting unit, wherein:

the first cutting unit comprises a first external cutting member having a plurality of hair entry openings which define a first shaving track, a first internal cutting member which is rotatable relative to the first external cutting member about a first axis of rotation, and a first housing accommodating a first hair collection chamber;

the second cutting unit comprises a second external cutting member having a plurality of hair entry openings which define a second shaving track, a second internal cutting member which is rotatable relative to the second external cutting member about a second axis of rotation, and a second housing accommodating a second hair collection chamber; the shaving unit further comprising a central support member comprising a coupling member by means of which the shaving unit can be releasably coupled to a main housing of the shaving apparatus, wherein:

the coupling member accommodates a central drive shaft which is connected to a central transmission element;

the first housing is pivotally mounted to the central support member by means of a first primary pivot axis arranged between the first axis of rotation and the second axis of rotation;

the second housing is pivotally mounted to the central support member by means of a second primary pivot axis arranged between the second axis of rotation and the first axis of rotation;

the first internal cutting member is connected to a first driven transmission element via a first drive spindle;

the second internal cutting member is connected to a second driven transmission element via a second drive spindle; and the first and second driven transmission elements are arranged to be driven by the central transmission element;

wherein the central transmission element and the first and second driven transmission elements are arranged as a transmission unit between the coupling member and the first and second cutting units, wherein the first and second drive spindles extend from the transmission unit via an open space, which is present between the transmission unit and the first and second cutting units and surrounds the central support member, and through an opening in a bottom wall of, respectively, the first housing and the second housing.

According to the invention the shaving unit comprises at least two cutting units and may in particular comprise three, four, five or even more cutting units to form a two-, three-, four-headed or five-headed or multi headed shaving unit. Each cutting unit comprises an external cutting member which is provided with a plurality of hair entry openings like circular openings or slits through which the hair which is to be cut can reach through. The external cutting member provides cutting edges at the hair entry openings which interact with cutting edges at the internal cutting member which is rotatable relative to the external cutting member. By this rotation of the internal versus the external cutting member a shearing force is imparted by the cutting edges of the internal and the external cutting members on the hairs which reach through the hair entry openings, and this shearing or cutting force effects the shaving action. The cut hairs fall into a hair collection chamber which is provided in a housing incorporated in each cutting unit.

Each cutting unit, having the internal cutting member, the external cutting member and the housing incorporating the hair collection chamber, is pivotal, preferably individually pivotal independent of the other cutting unit or units, relative to the central support member about a primary pivot axis to allow a good contour following of the cutting units along the skin.

Further, a drive train is provided for driving each internal cutting member into rotation in relation to the external cutting member. The drive train comprises a central drive shaft, in particular a single central drive shaft, which is accommodated in a central coupling member of the central support member of the shaving unit. The single central drive shaft is adapted to be coupled to a main drive shaft of a drive unit, like an electric motor, in the main housing. For this purpose the central drive shaft may have a suitable coupling element to be driven into rotation by a mating coupling element of the main drive shaft when coupled thereto. The central drive shaft is connected to a central transmission element, like a central gear wheel or the like, which engages a first and a second driven transmission element, like driven gear wheels, such that a rotation of the central transmission element effects a rotation of the first and second driven transmission elements. The first and second driven transmission elements are coupled via a first and a second drive spindle, respectively, to the first and second cutting units such as to drive the first and second internal cutting members, respectively, into rotation.

The spindles extend outside the central support member, which serves to centrally support the first and the second cutting units. The first and the second spindles extend in an open space which is present between a transmission unit, comprising the central transmission element and the first and second driven transmission elements, and the first and second cutting units. An open space is understood to be a space which is not physically separated from the environment of the shaving unit, i.e. which is not encapsulated by a housing. In this regard, the open space is understood to be accessible from outside, i.e. the open space may be used to direct a flush water stream or an airflow or compressed air jet to clean the cutting units. By this arrangement of the spindles, the transmission unit, including the central transmission element and the first and second driven transmission elements, is arranged at a distance from the first and second cutting units and separated from the first and second cutting units by the open space.

The first and second cutting units and any optional further cutting units form a type of cutting head of the shaving unit which is carried by the central support member and connected to the transmission unit by this central support member. The spindles extend sideways from the central support member in the open space surrounding the central support member. By this, the cutting units have a large range of motion to follow the skin contour and can pivot about large angles and multiple pivot axes. In particular, the pivotal motions of the cutting units about their primary pivot axes are not restricted by the required engagement between the central transmission element and the driven transmission elements. Further, the open space provided adjacent to the bottom sides of the cutting units allows a direct access to the housings of the cutting units accommodating the hair collection chambers, and thus facilitates the access to the hair collection chambers of the cutting units for cleaning the cutting units and removing cut hair out of the cutting units.

According to a first preferred embodiment, the central transmission element is rotatable about a central transmission axis, the first driven transmission element is rotatable about a first transmission axis, and the second driven transmission element is rotatable about a second transmission axis, wherein the central transmission axis and the first and second transmission axes are arranged in stationary positions relative to the coupling member. According to this embodiment, the transmission axis of the central transmission element and the first and second driven transmission elements are in a constant orientation relative to the coupling member, such that the transmission axis and the driven transmission axes do not change their angular orientation in relation to each other, and each of the transmission axis and driven transmission axes does not change its angular orientation in relation to the coupling member in case of a pivotal movement of any cutting unit. By this, the transmission via the drive train from the central drive shaft in the coupling member to the first and second driven transmission elements is free of any pivoting movement, such that a transmission of the rotational movement and torque is achieved at low friction and wear of the components involved in the transmission. In particular, no pivoting movement of any of the driven transmission elements in relation to the central transmission element is required in the course of the pivoting movement of the cutting units when following the skin contour. Hereby, increased wear and friction in the transmission can be avoided and the shaving unit can be driven at a low noise level. It is understood that the stationary position of the axes of the central transmission element and the driven transmission elements relative to the coupling member as described beforehand does not exclude a pivotal movement of other components of the drive train such as to follow a pivotal movement of the cutting units or a translational movement of any such components.

According to a further preferred embodiment, the central transmission element and the first and second driven transmission elements are accommodated in a transmission housing which is arranged in a stationary position relative to the coupling member between the coupling member and the open space. According to this embodiment the central transmission element, the first driven transmission element and the second driven transmission element are encapsulated in a transmission housing and thus protected from impact or environmental influence. It is understood that the transmission housing may be part of a housing which accommodates additional parts, and the transmission housing may have a section comprising the coupling member to realize the releasable coupling of the shaving unit to the main housing. Preferably, the open space is positioned between the cutting units and the transmission housing such that a sufficient range of pivotal motions of the cutting units is provided by said open space without the cutting units contacting the transmission housing in any pivotal position.

It is further preferred that the central transmission element comprises a central gear wheel and the first and second driven transmission elements each comprise a driven gear wheel. According to this embodiment, the transmission via the central transmission element and the driven transmission elements is accomplished by gear wheels like e.g. spur-gears, bevel gears or the like. The gear wheels may provide a gear reduction or a gear transmission ratio with speed increaser such as to adapt the rotational speed of the drive unit to an appropriate rotational speed of the internal cutting members.

According to a further preferred embodiment, the shaving unit is improved in that, seen in a direction parallel to the first axis of rotation, the first primary pivot axis is arranged between the first shaving track and the second axis of rotation, and wherein, seen in a direction parallel to the second axis of rotation, the second primary pivot axis is arranged between the second shaving track and the first axis of rotation. By this particular arrangement of the first and second primary pivot axes it is achieved that the shaving track of a cutting unit can pivot about the primary pivot axis in such a way that the whole shaving track not only makes a pivoting action but further makes a translational movement in a tangential direction in relation to the respective primary pivot axis. Thus, any sector of the shaving track is positioned at a distance from the respective primary pivot axis, seen in a direction parallel to the axis of rotation of the internal cutting member of the cutting unit. By this, the whole shaving track will conduct a translational movement along a curved path in the same direction, i.e. either in the direction towards the skin or away from the skin, if the cutting unit pivots about the primary pivot axis. It is understood that some sectors may make a larger movement than others, depending on the distance to the primary pivot axis. It is however avoided that any sector of the shaving track is not able to make such a translational movement, but is positioned in a fixed position and only changes its angular orientation in relation to the skin when following the contour of the skin, or may even conduct a translational movement opposed to other regions of the shaving track. The inventors have found that, in particular by avoiding such fixed positions of parts of the shaving track with regard to the translational movement and by avoiding such opposed translational movements of parts of the shaving track versus other parts of the shaving track, pressure peaks between the contact surface of the shaving track and the skin, resulting in an uncomfortable and inconvenient shaving procedure with less shaving efficiency, are avoided.

According to a further preferred embodiment, the first primary pivot axis and the second primary pivot axis coincide. Such coinciding pivot axes will allow for a close relationship between the first and second cutting units and at the same time provide a rigid mechanical setup of the pivoting action about the first and second primary pivot axes.

According to a further preferred embodiment, the central support member comprises a stationary portion, which comprises the coupling member, and a movable portion, which is pivotal relative to the stationary portion about a secondary pivot axis, wherein the first housing is pivotally mounted to the movable portion by means of the first primary pivot axis and the second housing is pivotally mounted to the movable portion by means of the second primary pivot axis, and wherein the secondary pivot axis is not parallel to the first and second primary pivot axes. According to this embodiment, a secondary pivot axis is provided, so that the first and second cutting units can pivot relative to the stationary portion of the central support member both about, respectively, the first and the second primary pivot axis and about said secondary pivot axis. The secondary pivot axis is not parallel to the first and the second primary pivot axis. For this purpose, the central support member comprises two portions, namely a stationary portion and a movable portion, wherein the movable portion is pivotal relative to the stationary portion about said secondary pivot axis. It is understood that such pivotal movement of the movable portion versus the stationary portion may be provided by an axle or shaft mutually coupling the movable and the stationary portions, but instead of such a coupling via an axle or shaft the movable and the stationary portions of the central support member may be coupled via a guiding structure comprising a curved path, or the like, along which the movable portion is guided relative to the stationary portion, such that the secondary pivot axis is provided as a virtual axis outside of the central support member, in particular outside of the shaving unit. like e.g. in the plane or close to the plane defined by the skin contact surface of the first or second shaving track. The secondary pivot axis is not arranged parallel to the first and second primary pivot axis, so that the pivotal movement about the secondary pivot axis follows a different path and direction than the pivotal movement about the first and the second primary pivot axis, and thus provides an increased skin-contour following ability of the cutting units. The first primary pivot axis, the second primary pivot axis and/or the secondary pivot axis may lie in planes which are parallel to each other. It is understood that, whilst the first and second cutting unit may pivot individually and independently from each other about the first and second primary pivot axis, respectively, the pivotal movement of the first and second cutting unit about the secondary pivot axis is a synchronous pivotal movement of both cutting units.

The embodiment of the shaving unit comprising a secondary pivot axis may be further improved in that the first housing and the second housing have a height, seen in respective directions parallel to the first axis of rotation and parallel to the second axis of rotation, and that a distance between the secondary pivot axis and a first skin contact surface comprising the first shaving track and a distance between the secondary pivot axis and a second skin contact surface comprising the second shaving track are smaller than 50% of said height. In this embodiment, the position of the secondary pivot axis is relatively close to the skin contact surface of the first and second shaving track, wherein it is understood that the secondary pivot axis may be positioned inside or outside the shaving unit. As a result, the position of the secondary pivot axis is optimized for a smooth pivotal movement of the first and second cutting units about said secondary pivot axis with low pivotal forces required for the pivoting movement. It is understood that the height of the first housing and the second housing may be similar, and that said height corresponds to the height of a single of said two housings such that the distance between the secondary pivot axis and the first skin contact surface is less than half of the height of the first housing. In particular, the secondary pivot axis may be positioned in a plane which includes the first and second primary pivot axes, or the secondary pivot axis may preferably be arranged outside the shaving unit, such that the first and second shaving tracks are positioned between the secondary pivot axis and the first and second internal cutting members. The secondary pivot axis may be realized as a physical or as a virtual secondary pivotal axis.

According to a further preferred embodiment, the first and second drive spindles each comprise a spindle axis, wherein the secondary pivot axis and the spindle axes of the first and second drive spindles extend in a common imaginary plane, and wherein the first and second primary pivot axes extend perpendicularly to the secondary pivot axis. The position of the secondary pivot axis and the spindle axes of the first and second drive spindles in a common imaginary plane allows the cutting units to pivot about the secondary pivot axis without any required displacement of the drive spindles, and in particular without any required displacement of the spindle axes of the drive spindles out of said imaginary plane. The orientation of the first and second primary pivot axes perpendicular to the secondary pivot axis in addition allows the cutting units to pivot about the primary pivot axes without any required displacement of the spindle axes of the drive spindles out of said imaginary.

According to a further preferred embodiment, the first drive spindle is pivotally arranged relative to the first driven transmission element, and the second drive spindle is pivotally arranged relative to the second driven transmission element. This pivotal arrangement of the first and the second drive spindles in relation to the first and the second driven transmission elements, respectively, allows the first and second drive spindles to follow the pivoting movement of the first and second cutting units, respectively. This may comprise any pivotal movement of the drive spindles following a pivotal movement of the cutting units about the first and second primary pivot axis, respectively, and/or about the secondary pivot axis. In particular, the first and second drive spindles may be coupled to the first and second driven transmission elements, respectively, by way of a form-locking torque transmission element which allows such pivotal movement. The pivot axis of the pivotal movement of the first and second drive spindles relative to the first and second driven transmission elements, respectively, may be oriented perpendicular to the rotational axis of the first and second driven transmission elements, respectively, and may in particular intersect the rotational axis of the respective driven transmission elements. The pivotal movement of the first and second drive spindles relative to the first and second driven transmission elements may be such that a movement about two perpendicular pivot axes or an arbitrary pivotal movement is possible, such as to form a cardan joint or a ball-joint bearing between the first and second drive spindles and the first and second driven transmission elements, respectively. This will allow the first and second drive spindles to follow a pivotal movement of the internal cutting members of the cutting units, which are driven by the respective drive spindles, in any rotational position of the respective driven transmission elements.

Further, it is generally preferred to have a coupling between the first and second drive spindles and the first and second driven transmission elements, respectively, which coupling allows a pivotal movement corresponding to a cardan joint or a ball-joint bearing, but at the same time provides a torque transmission about the first and second spindle axes and the couplings thereof, respectively.

According to a further preferred embodiment, the first and second drive spindles each comprise a spindle axis, wherein the first drive spindle is displaceable relative to the first driven transmission element in a direction parallel to the spindle axis of the first drive spindle and against a first spring force, and wherein the second drive spindle is displaceable relative to the second driven transmission element in a direction parallel to the spindle axis of the second drive spindle and against a second spring force. According to this embodiment, the first and second drive spindles are adapted to compensate a change of distance between the first and second cutting units, respectively, and the first and second driven transmission elements, respectively. Such a change of the distance may occur if the cutting units are pivoted about the first and second primary pivot axes, respectively, or about the secondary pivot axis. The expression "the first and second drive spindles being displaceable relative to the first and second driven transmission elements, respectively" may be understood such that the whole drive spindle may conduct a translational movement parallel to the respective spindle axis, e.g. such that the first and second drive spindles are coupled to the first and second driven transmission elements, respectively, by a coupling structure, which allows such a translational movement of the drive spindles in relation to the driven transmission elements and at the same time maintains the torque transfer from the first and second driven transmission elements to the first and second drive spindles, respectively. Alternatively, the first and second drive spindles may be displaceable in such a way that a first axial section of each drive spindle can conduct a movement parallel to the drive spindle axis in relation to a second axial section of the drive spindle, such that the drive spindle may change its length. The spring force is understood to act in a direction such as to bias the drive spindle into its maximally extended configuration, namely such as to bias the drive spindle towards the associated cutting unit by the spring force. In embodiments wherein the drive spindles have two mutually displaceable axial sections, the two axial sections of the drive spindle are biased by the spring force into a maximally extended configuration of the drive spindle. By this, a permanent contact and transmission from the driven transmission elements to the internal cutting members is provided by the drive spindles during any displacements of the cutting units in relation to the driven transmission elements in a direction parallel to the spindle axis, in particular as a result of any pivotal motion of the cutting units.

According to a further preferred embodiment, the first drive spindle is pivotally arranged relative to the first internal cutting member, and the second drive spindle is pivotally arranged relative to the second internal cutting member. According to this embodiment, the drive spindles are pivotally arranged in relation to the internal cutting members to which they are respectively coupled for transmission of rotational movement and torque. This arrangement further improves the ability of the drive spindles to follow any pivotal movement of the cutting units. Preferably, the drive spindles are pivotal in relation to the driven transmission elements and also pivotal in relation to the internal cutting members, such that a change of the angular orientation of the internal cutting members relative to the driven transmission elements, which may occur as a result of a pivotal movement of the cutting units about the primary pivot axes or about the secondary pivot axis, can be compensated and followed by the drive spindles, and the torque transmission from the driven transmission elements to the internal cutting members is maintained via the drive spindles in any pivotal position of the cutting unit. It is understood that the pivotal movement of the drive spindles versus the internal cutting members may be accomplished by a coupling structure allowing the freedom to move according to a ball-joint bearing with torque transmission about the spindle axes, or by a coupling structure providing two pivot axes forming a cardan joint, as described beforehand with respect to the pivotal movement of the drive spindles relative to the driven transmission elements.

According to a further preferred embodiment, the shaving unit comprises a third cutting unit comprising a third external cutting member having a plurality of hair entry openings, a third internal cutting member which is rotatable relative to the third external cutting member about a third axis of rotation, and a third housing accommodating a third hair collection chamber, wherein:

the third housing is pivotal relative to the central support member about a third primary pivot axis arranged between the third axis of rotation and each of the first and second axes of rotation;

the third internal cutting member is connected, via a third drive spindle, to a third driven transmission element of the transmission unit arranged to be driven by the central transmission element; and the third drive spindle extends from the transmission unit via the open space and through an opening in a bottom wall of the third housing.

According to this embodiment, a third cutting unit is provided which is pivotal relative to the central support structure about a third primary pivot axis. Said third primary pivot axis may be arranged between each of the first and second axes of rotation and a shaving track of the third external cutting member defined by the hair entry openings of the third external cutting member, and may in particular be arranged between each of the first and second axes of rotation and the third external cutting member, as was described beforehand with respect to the corresponding positions of the first and the second primary pivot axes relative to the first and the second cutting units, respectively.

The third housing of the third cutting unit may be pivotally mounted to the central support member directly, or may be pivotally mounted to the first housing, to the second housing, or to both the first housing and the second housing. In particular, the third primary pivot axis may be mounted to both the first housing and the second housing in such a way that it allows a pivotal movement of the first and the second housings about the first and the second primary pivot axes, respectively, but at the same time provides a pivotal bearing of the third housing.

It is further preferred that the third primary pivot axis extends perpendicularly to the first and second primary axes. The third primary pivot axis may in such case form a T-like arrangement with the first and the second primary axes, in particular in embodiments wherein the first and second primary axes coincide. Said T-like arrangement formed by the first, second and third primary pivot axes may be positioned between the first, second and third cutting units. In another preferred embodiment, the first, second and third primary pivot axes may be arranged in a triangular arrangement relative to each other, e.g. such that a triangle formed by said three primary pivot axes is positioned between the first, second and third cutting units.

The internal cutting member of the third cutting unit is connected to a third driven transmission element via a third drive spindle. Said third drive spindle may be configured in the same way like the first and second drive spindles and may be displaceable parallel to the spindle axis of the third drive spindle and pivotal in relation to the third driven transmission element and/or the third internal cutting member to follow a pivotal movement of the third cutting unit. The first, second and third drive spindles may be arranged in such a way as to be evenly distributed in angular relationship about the rotational axis of the central transmission element, i.e. to be in angular displacement of 120 degree to each other. All three drive spindles may extend in the open space such as to provide a sufficient range of pivotal motions for the three cutting units and a good accessibility of the cutting units for cleaning purposes.

In a shaving unit comprising a third cutting unit as described beforehand, it is further preferred that the first and second primary pivot axes are mutually parallel or coinciding, and that the third housing is connected to the first housing and to the second housing by means of, respectively, a first hinge structure and a second hinge structure, wherein the first and second hinge structures each comprise a bearing pin engaging a bearing bush, wherein the bearing bush, seen in a longitudinal sectional view along the third primary pivot axis, has a non-cylindrical, in particular a convex bearing surface such as to allow mutual rotation of the bearing pin and the bearing bush about an axis parallel to the first and second primary pivot axes. Generally, it is preferred that the third primary pivot axis is not parallel to the first and/or the second primary pivot axis such as to allow a non-parallel pivotal movement of the three cutting units to achieve a good contour following efficiency of the shaving unit. Whilst generally the pivotal coupling of each cutting unit might be established directly between the housing of the cutting unit and the central support member, according to this embodiment it is preferred that the housing of the third cutting unit is pivotally coupled directly to the housings of both the first cutting unit and the second cutting unit. This allows for a close arrangement of the three cutting units with a relatively small distance between each of the three cutting units, which is preferred for an efficient shaving procedure. The first and second hinge structures provided for the third primary axis in this case compensate for any pivotal movement of the first and/or the second cutting unit about the first and second primary pivot axes, respectively. For this purpose, in the first and second hinge structures the bearing bush receiving the bearing pin is not formed as a straight cylindrical bush, but has a convex bearing surface to allow a tilting motion of the associated bearing pin in the bearing bush to a certain degree. This allows the bearing pin to follow any pivotal motion of the bearing bush about, respectively, the first or the second primary pivot axis while being accommodated in the bearing bush, and thus to compensate a tilted arrangement of the bearing pin, when mounted in a fixed position relative to the housing of the third cutting unit, relative to the bearing bush, when mounted in a fixed position relative to the housing of the first or the second cutting unit, respectively. The shape of the bearing surface of the bearing bush may be bevelled, e.g. convergent, i.e. funnel-shaped to allow such tilting of the bearing pin, or the bearing surface may have a central portion with a diameter corresponding to the diameter of the bearing pin, wherein the diameter of the bearing bush widens from the central portion towards both end portions of the bearing bush. As a result, a double-bevelled shape of the bearing surface, as e.g. known from an hour-glass, is provided, which allows tilting of the bearing pin in the bearing bush to a certain degree. The third primary pivot axis may be formed by at least one bearing pin extending along the third primary pivot axis, said bearing pin being accommodated in a corresponding at least one bearing bush, wherein said bearing pin or bearing bush is provided in the first or second housing and said bearing bush has a converging shape or an hourglass shape to allow pivoting of the bearing pin about the first or the second primary pivot axis.

According to a further preferred embodiment, the first housing and the second housing each comprise, near its opening in its bottom wall, a first sealing structure which is symmetrical relative to, respectively, the first axis of rotation and the second axis of rotation, wherein the first internal cutting member and the second internal cutting member each comprise a second sealing structure, which is symmetrical relative to, respectively, the first axis of rotation and the second axis of rotation and arranged for cooperation with the first sealing structure of, respectively, the first housing and the second housing. According to this embodiment, first and second sealing structures are provided in, respectively, the first and the second housings and in the first and the second internal cutting members such as to provide a sealing between the first and second housing and, respectively, the first and second internal cutting members. The first and the second sealing structures engage and cooperate with each other in such a way as to provide a sealing gap between the internal cutting members and the housings. These sealing gaps in particular prevent cut hairs to escape out of the hair collection chambers accommodated in the housings via the openings of the housings through which the drive spindles extend. The sealing gaps may allow flush water to flow from outside, in particular from the open space, into the hair collection chambers so as to effect a cleaning of the hair collection chambers by removing cut hairs out of the hair collection chambers. The first sealing structure may be an annular structure, like a ring-shaped plane, and the second sealing structure may be a further annular structure which is opposed to the first sealing structure such that a sealing gap is provided between said two annular structures. The annular structures may both have a ring-like configuration and may be rotationally symmetric about the axis of rotation of the associated internal cutting member. In particular, the sealing gap may have a convergent geometry in a longitudinal sectional view in such a way that the width of the sealing gap decreases in a flow direction from the opening in the housing towards the hair collection chamber. This particular convergent shape of the sealing gap will prevent cut hairs from passing through the sealing gap, but at the same time will allow flush water to enter through the sealing gap into the hair collection chamber.

It is understood that also the third internal cutting member and the third housing may incorporate such a first and second sealing structure and a sealing gap formed by said first and second sealing structure in the same way such as to seal the opening in the third housing to prevent cut hairs from escaping out of the hair collection chamber through said opening and to allow flush water to enter into the third hair collection chamber for removal of the cut hair.

A further aspect of the invention is a shaving apparatus comprising a main housing accommodating a motor, and comprising a shaving unit as described beforehand, wherein the shaving unit is releasably coupled to the main housing by means of the coupling member. Said shaving apparatus may incorporate in said main housing a drive unit, like an electric motor, to drive the first, second and, if present, third internal cutting member when the shaving unit is coupled to the main housing by means of the coupling member. The drive unit may have a main drive shaft which is coupled to the central drive shaft, accommodated in the coupling member of the shaving unit, when the shaving unit is coupled to the main housing. The main housing may further comprise a main coupling member to cooperate with the coupling member of the shaving unit.

It shall be understood that a shaving unit according to the invention and a shaving apparatus according to the invention may have similar and/or identical preferred embodiments, in particular as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

BRIEF DESCRIPTION OF THE DRAWINGS

Preferred embodiments of the invention are described with reference to the drawings.

In the drawings.

DETAILED DESCRIPTION OF THE EMBODIMENTS

Figure 1A:
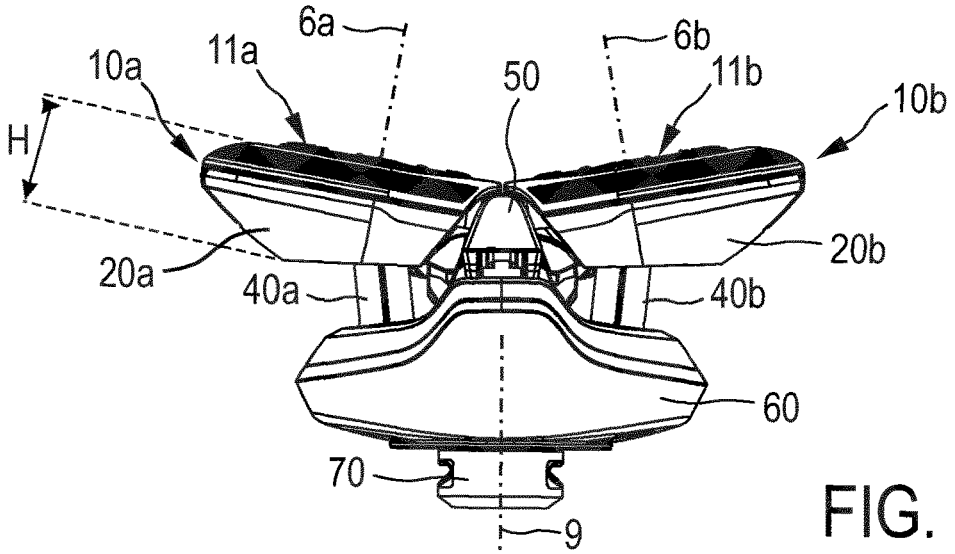
FIGS. 1*a*-1*c* show a frontal view of three pivoted configurations of a shaving unit according to a first embodiment of the invention.
Figure 1B:
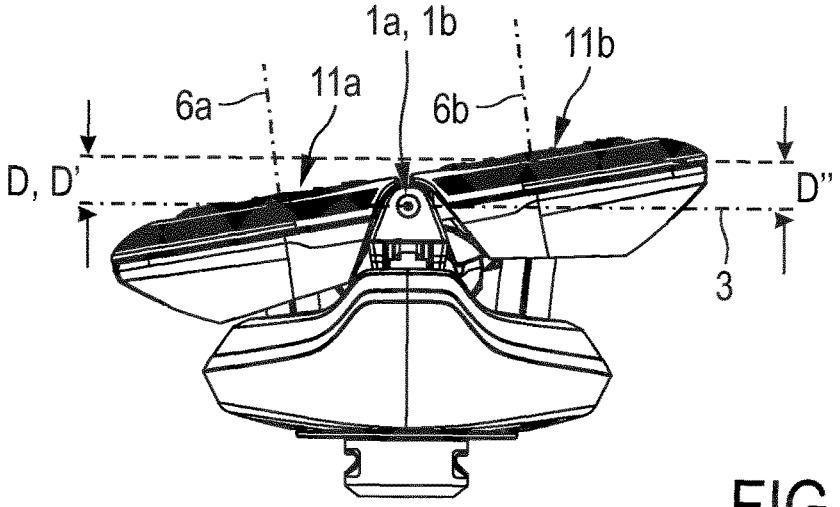
Figure 1C:
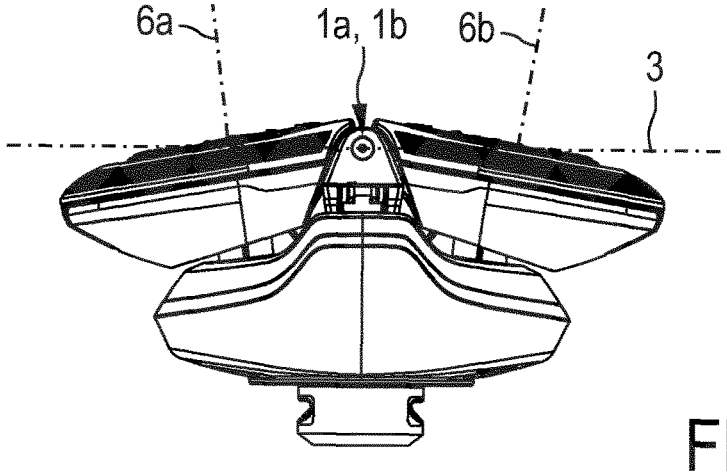

With reference to FIGS. 1*a*-1*c* a shaving unit for a shaving apparatus according to the invention is shown. The shaving unit has two cutting units, i.e. a first cutting unit 10*a* and a second cutting unit 10*b*, which are shown in three different pivoted positions with respect to each other. Each cutting unit 10*a*, 10*b* comprises an external cutting member 12, which is partially visible in FIG. 3. The external cutting member 12 comprises a plurality of hair entry openings 13, e.g. in the form of elongated slits. Via the hair entry openings 13, hairs present on the skin can enter the cutting units 10*a*, *b*. The hair entry openings 13 define a first shaving track 11*a* of the first cutting unit 10*a* and a second shaving track 11*b* of the second cutting unit 10*b*. In FIGS. 1*a*-1*c* the shaving tracks 11*a*, 11*b* are partially visible as protruding relative to, respectively, an upper surface of a first housing 20*a* of the first cutting unit 10*a* and an upper surface of a second housing 20*b* of the second cutting unit 10*b*. Each cutting unit 10*a*, 10*b* further comprises an internal cutting member, which is accommodated in the respective housing 20*a*, 20*b* and rotatable relative to the external cutting member 12 about a respective first and second axis of rotation 6*a*, 6*b*. The internal cutting members of the cutting units 10*a*, 10*b* are not visible in the FIGS. 1*a*-1*c*. They may have a structure with a plurality of cutting elements, as is well known for the person skilled in the art, and will not be described in further detail. Each internal cutting member is coupled via a respective drive spindle 40*a*, 40*b* to a transmission unit 60 of the shaving unit. The transmission unit 60 may comprise a set of transmission gear wheels for transmitting the rotational motion of a central drive shaft, which is rotatable about a main drive axis 9, into rotational motions of the drive spindles 40*a*, 40*b*. The central drive shaft, which is not visible in FIGS. 1*a*-1*c*, is accommodated in a coupling member 70 of the shaving unit. By means of the coupling member 70, the shaving unit can be releasbly coupled to a main housing of the shaving apparatus, which is also not shown in the figures. The coupling member 70 is part of a central support member 50 of the shaving unit. The central support member 50 supports the first and second cutting units 10*a*, 10*b*.

Figure 6:
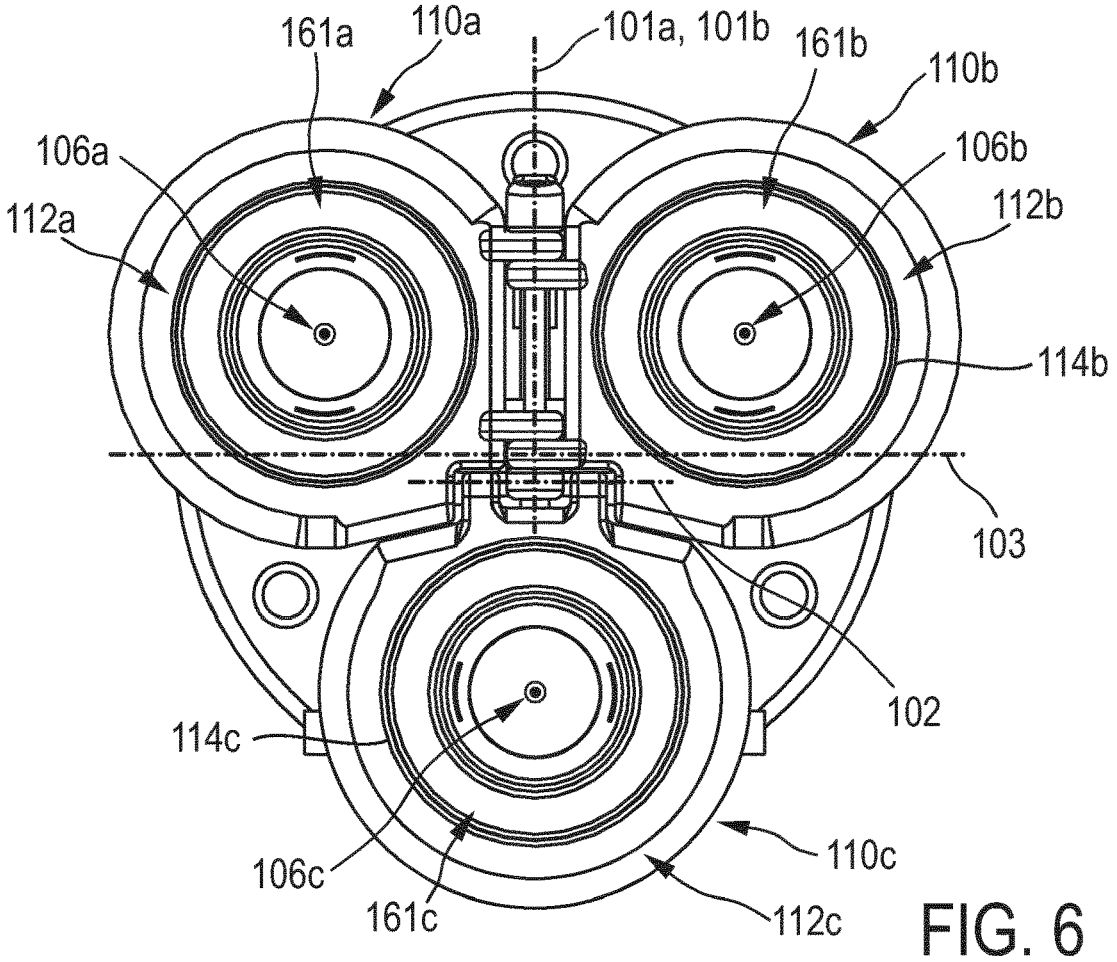
FIG. 6 shows a top view of the shaving unit of FIG. 5.

The first housing 20*a* of the first cutting unit 10*a* is pivotally mounted to the central support member 50 by means of a first primary pivot axis 1*a*, and the second housing 20*b* of the second cutting unit 10*b* is pivotally mounted to the central support member 50 by means of a second primary pivot axis 1*b*. In the embodiment shown in FIGS. 1*a*-1*c*, the first and second primary pivot axes 1*a*, 1*b* coincide. The primary pivot axes 1*a*, 1*b* may also be non-coincident, i.e. they may constitute two separate parallel or non-parallel primary pivot axes about which the first and second cutting units 10*a*, 10*b* are pivotal relative to the central support member 50, respectively. In the embodiment shown in FIGS. 1*a*-1*c*, the first and second primary pivot axis 1*a*, 1*b* are arranged between the first and second axes of rotation 6*a*, 6*b* of the internal cutting members. More particular, seen in a direction parallel to the first axis of rotation 6*a*, the first primary pivot axis 1*a* is arranged between the first shaving track 11*a* and the second axis of rotation 6*b* and, seen in a direction parallel to the second axis of rotation 6*b*, the second primary pivot axis 1*b* is arranged between the second shaving track 11*b* and the first axis of rotation 6*a*. Such an arrangement of the primary pivot axes 1*a*, 1*b* is shown in FIGS. 1*a*-1*c*. Such an arrangement of the primary pivot axes 101*a*, 101*b* is also visible in the embodiment of the shaving unit as shown in FIG. 6, which will be further described hereinafter. In the embodiments of the shaving unit shown in FIGS. 1*a*-1*c* and in FIG. 6, seen in directions parallel to the first and second axes of rotation 6*a*, 6*b*, the first and second primary pivot axes 1*a*, 1*b*; 101*a*, 101*b* are in particular arranged between the external cutting members 12; 114*a*, 114*b* of the cutting units 10*a*, 10*b*; 110*a*, 110*b*, respectively. However, in an alternative embodiment of a shaving unit according to the invention, the primary pivot axes may be arranged in positions which are not or not fully between the external cutting members of the cutting units, e.g. in positions wherein the primary pivot axes cross the external cutting members in circumferential areas of the external cutting members. In the embodiment shown in FIGS. 1*a*-1*c*, however, the first primary pivot axis 1*a* is arranged between the first shaving track 11*a* and the second axis of rotation 6*b*, and the second primary pivot axis 1*b* is arranged between the second shaving track 11*b* and the first axis of rotation 6*a*. I.e. the first primary pivot axis 1*a* is positioned outwardly from the first shaving track 11*a* in a radial direction with respect to the first axis of rotation 6*a*, and consequently does not cross or cover any of the hair entry openings 13 of the external cutting member 12 of the first cutting unit 10*a*, seen in the direction of the first axis of rotation 6*a*. The same applies for the second primary pivot axis 1*b* relative to the second shaving track 11*b* and the second axis of rotation 6*b*. Furthermore, the primary pivot axes 1*a*, 1*b* each extends parallel to a plane wherein, respectively, the first and second shaving tracks 11*a*, 11*b* extend.

As will be described further in detail in the following, the central support member 50 comprises a stationary portion, which comprises the coupling member 70, and a movable portion. The first and second housings 20*a*, 20*b* of the cutting units 10*a*, 10*b* are pivotal about the first and second primary pivot axes 1*a*, 1*b* relative to the movable portion of the central support member 50. The movable portion of the central support member 50 is pivotal relative to the stationary portion of the central support member 50 about a secondary pivot axis 3 as indicated in FIGS. 1*a*-1*c*. In general, the secondary pivot axis 3 is not parallel to the first and second primary pivot axes 1*a*, 1*b*. In the embodiment shown in FIGS. 1*a*-1*c*, wherein the first and second primary pivot axes 1*a*, 1*b* coincide, the secondary pivot axis 3 extends perpendicularly to the coinciding first and second primary pivot axes 1*a*, 1*b*.

FIG. 1*a* shows the first and second cutting units 10*a*, 10*b* in a spring-biased neutral pivoted position, wherein the first cutting unit 10*a* is pivoted about the first primary pivot axis 1*a* in a clockwise direction into a maximum pivot angle, delimited by a mechanical stop not shown in the figures, and wherein the second cutting unit 10*b* is pivoted about the second primary pivot axis 1*b* in an anti-clockwise direction to a maximum pivot angle, which is also delimited by a mechanical stop not shown in the figures. These pivoted positions of the first and second cutting units 10*a*, 10*b* result in a concave V-shaped configuration of the first and second cutting units 10*a*, 10*b* and the first and second shaving tracks 11*a*, 11*b*.

FIG. 1*b* shows pivoted positions of the cutting units 10*a*, 10*b*, wherein the first and the second cutting units 10*a*, 10*b* are both pivoted about the primary pivot axes 1*a*, 1*b* in an anti-clockwise direction. In these pivoted positions of the cutting units 10*a*, 10*b*, the first and second shaving tracks 11*a*, 11*b* extend in a common plane shape which is oriented obliquely in relation to the main drive axis 9.

FIG. 1*c* shows pivoted positions of the cutting units 10*a*, 10*b*, wherein the first cutting unit 10*a* is pivoted about the first primary pivot axis 1*a* in an anti-clockwise direction, while the second cutting unit 10*b* is pivoted about the second primary pivot axis 1*b* in a clockwise direction. These pivoted positions of the cutting units 10*a*, 10*b* result in a convex V-shaped configuration of the first and second cutting units 10*a*, 10*b* and the first and second shaving tracks 11*a*, 11*b*. It is to be understood that the pivoted positions of the cutting units 10*a*, 10*b* shown in FIGS. 1*a*-1*c* are possible because the cutting units 10*a*, 10*b* are individually and mutually independently pivotal about the primary pivot axes 1*a*, 1*b*. I.e. the first cutting unit 10*a* can perform any pivotal motion about the first primary pivot axis 1*a* independently of any pivotal motion of the second cutting unit 10*b* about the second primary pivot axis 1*b*, and v.v.

Figure 2A:
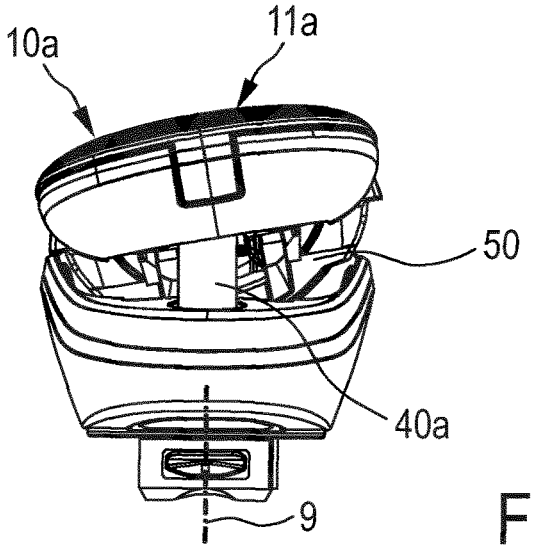
FIGS. 2*a*-2*c* show a side view of three pivoted configurations of the shaving unit of FIGS. 1*a*-1*c;*
Figure 2B:
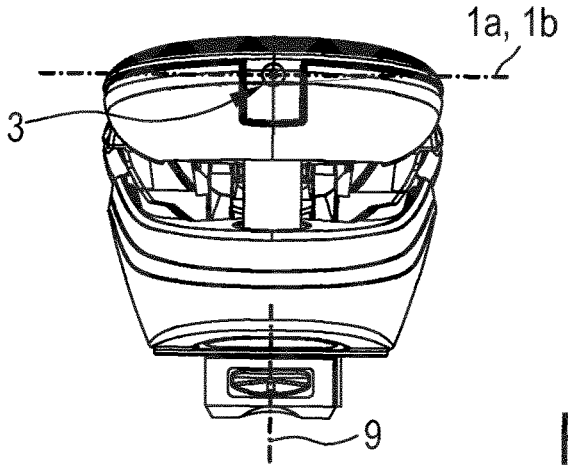
Figure 2C:
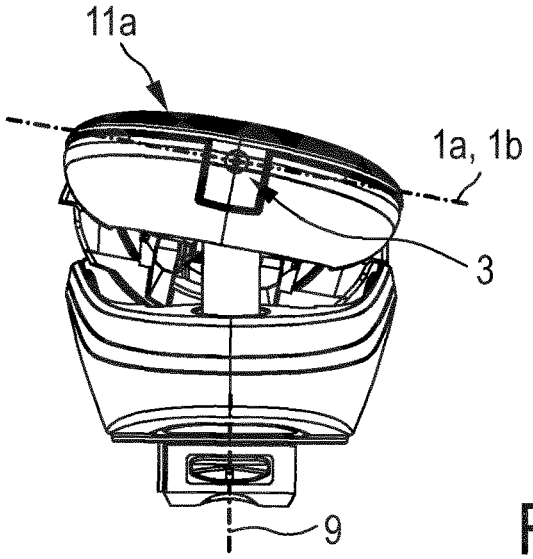

FIGS. 2*a*-2*c* show a side view of the first and second cutting units 10*a*, 10*b* in three different pivoted positions about the secondary pivot axis 3. In FIG. 2*a* the movable portion of the central support member 50, with the cutting units 10*a*, 10*b* connected thereto via the primary pivot axes 1*a*, 1*b*, is pivoted relative to the stationary portion of the central support member 50 in an anti-clockwise direction about the secondary pivot axis 3. FIG. 2*b* shows a neutral position of the movable portion with no pivoting of the cutting units 10*a*, 10*b* about the secondary pivot axis 3. FIG. 2*c* shows a third pivoted configuration wherein the movable portion of the central support member 50, with the cutting units 10*a*, 10*b* connected thereto via the primary pivot axes 1*a*, 1*b*, is pivoted relative to the stationary portion of the central support member 50 in a clockwise direction about the secondary pivot axis 3.

Figure 3:
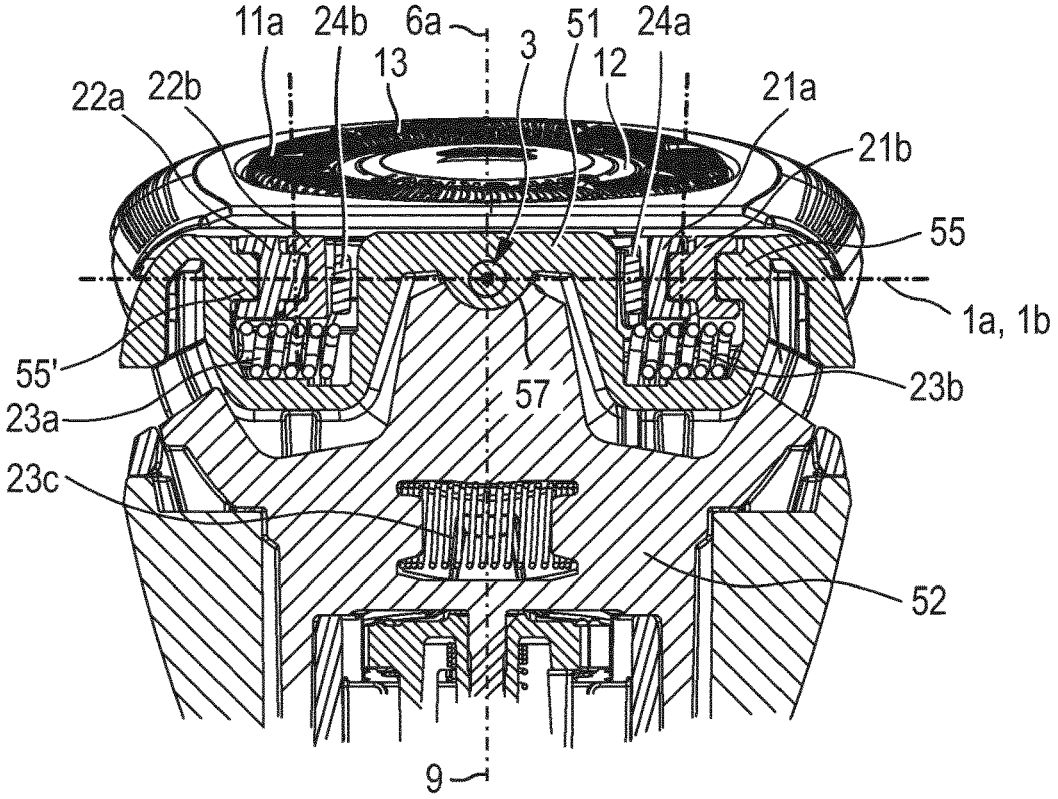
FIG. 3 shows a cross-sectional view of the shaving unit of FIGS. 1*a*-1*c* along the line 1 in FIG. 4.

FIG. 3 shows a cross-sectional view of the shaving unit shown in FIGS. 1*a*-1*c*, and FIG. 4 shows a top view of said shaving unit with parts of the cutting units 10*a*, 10*b* being removed. As can be seen in these figures, both the coinciding primary pivot axes 1*a*, 1*b* and the secondary pivot axis 3 extend in a direction perpendicular to the main drive axis 9 in a non-pivoted position of the cutting units 10*a*, 10*b* about the primary pivot axes 1*a*, 1*b* and the secondary pivot axis 3.

Figure 4:
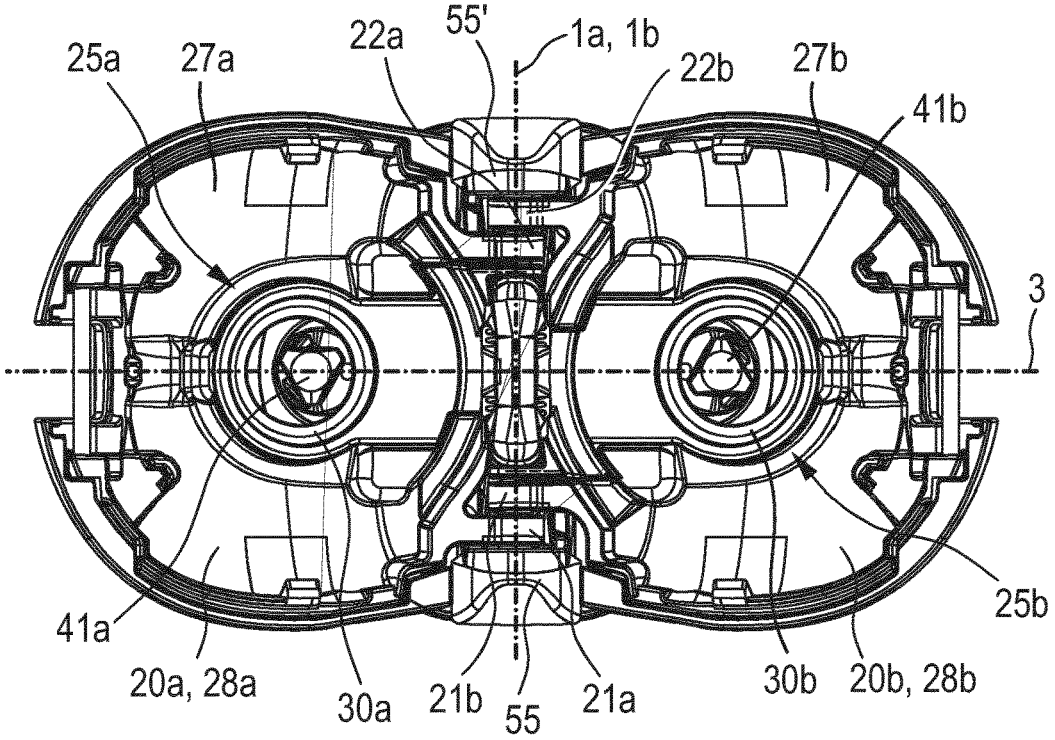
FIG. 4 shows a partial cut away top view of the shaving unit of FIGS. 1*a*-1*c;*

As shown in FIG. 4, the first housing 20*a* of the first cutting unit 10*a* accommodates a first hair collecting chamber 27*a*, and the second housing 20*b* of the second cutting unit 10*b* accommodates a second hair collecting chamber 27*b*. The first and second hair collecting chambers 27*a*, 27*b* each have an annular shape. The first hair collecting chamber 27*a* surrounds a central opening 25*a* which is provided in a bottom wall 28*a* of the first housing 20*a*. Likewise, the second hair collecting chamber 27*b* surrounds a central opening 25*b* which is provided in a bottom wall 28*b* of the second housing 20*b*. As can be seen in FIG. 4, coupling elements 41*a*, 41*b*, which are provided on upper end portions of, respectively, the drive spindles 40*a*, 40*b*, extend through, respectively, the openings 25*a*, 25*b*. In the assembled condition of the cutting units 10*a*, 10*b*, the coupling elements 41*a*, 41*b* engage the internal cutting members of, respectively, the first cutting unit 10*a* and the second cutting unit 10*b* to transfer a rotational motion of the drive spindles 40*a*, 40*b* to the internal cutting members. It is to be understood that the internal cutting members and the external cutting members of the cutting units 10*a*, 10*b* are not shown in FIG. 4, while in FIG. 3 only the external cutting member 12 of the first cutting unit 10*a* is visible.

As shown in FIGS. 3 and 4, the coinciding first and second primary pivot axes 1*a*, 1*b* are defined by a first hinge structure, which mutually connects the first housing 20*a* and the second housing 20*b*, and by a second hinge structure, which connects an assembly of the mutually connected first and second housings 20*a*, 20*b* to the movable portion 51 of the central support member 50. FIG. 3 further shows the stationary portion 52 of the central support member 50. Said first and second hinge structures have coinciding hinge axes. The first hinge structure comprises cooperating first and second hinge elements 21*a*, 21*b*, which are connected to, respectively, the first housing 20*a* and the second housing 20*b*, and cooperating third and fourth hinge elements 22*a*, 22*b*, which are connected to, respectively, the first housing 20*a* and the second housing 20*b*. A bearing pin formed on the second hinge element 21*b* engages a bearing cavity formed in the first hinge element 21*a*, and a bearing pin formed on the third hinge element 22*a* engages a bearing cavity formed in the fourth hinge element 22*b*. The second hinge structure comprises two bearing pins 55 and 55' which are integrally formed on the moveable portion 51 of the central support member 50. The two bearing pins 55 and 55' are arranged coaxially and face each other. The bearing pin 55 engages a bearing cavity, which is formed in the second hinge element 21*b* and is arranged coaxially with the bearing pin formed on the second hinge element 21*b*. The bearing pin 55' engages a bearing cavity, which is formed in the third hinge element 22*a* and is arranged coaxially with the bearing pin formed on the third hinge element 22*a*. The first and second hinge structures, comprising the hinge elements 21*a*, 21*b*, 22*a*, 22*b* formed on the housings 20*a*, 20*b* and the two bearing pins 55, 55', formed on the movable portion 51 of the central support member 50, provide the coincident primary pivot axes 1*a*, 1*b* in a simple and robust manner. During assembly of the shaving unit, the hinge elements 21*a*, 21*b* and 22*a*, 22*b* can be simply snapped into each other thereby forming an assembly of the first and second housings 20*a*, 20*b*. Subsequently said assembly can be simply snapped in between the two bearing pins 55, 55'. Finally, as shown in FIG. 3, filling elements 24*a*, 24*b* may be arranged between, respectively, the hinge elements 21*a*, 22*b* and the movable portion 51 of the central support member 50 to fill the gaps which are required for assembling the first and second hinge structures. The filling elements 24*a*, 24*b* prevent unintentional disassembling of the first and second hinge structures during use of the shaving unit.

The bearing pins 55, 55' define the position of the coinciding primary pivot axes 1*a*, 1*b* relative to the housings 20*a*, 20*b*. The bearing pins 55, 55' are arranged between the housings 20*a*, 20*b*, seen in directions parallel to the axes of rotation 6*a*, 6*b* of the cutting units 10*a*, 10*b* as e.g. in FIG. 4. As can further be seen in FIGS. 1*a* and 1*b*, seen in a direction parallel to the secondary pivot axis 3, in the neutral pivoted position of the first cutting unit 10*a* (FIG. 1*a*) the first primary pivot axis 1*a* is arranged between a skin contact surface of the first shaving track 11*a* and a bottom of the first housing 20*a*. Similarly, seen in a direction parallel to the secondary pivot axis 3, in the neutral pivoted position of the second cutting unit 10*b* (FIG. 1*b*) the second primary pivot axis 1*b* is arranged between a skin contact surface of the second shaving track 11*b* and a bottom of the second housing 20*b*. The first and second housings 20*a*, 20*b* each have an identical height H, seen in respective directions parallel to the first axis of rotation 6*a* and parallel to the second axis of rotation 6*b*. In an intermediate pivoted position of the cutting units 10*a*, 10*b* between the pivoted positions as shown in FIGS. 1*a* and 1*c*, wherein the first and second shaving tracks 11*a*, 11*b* extend in a common plane, a distance D between the first primary pivot axis 1*a* and the skin contact surface of the first shaving track 11*a*, in particular measured in a central imaginary plane comprising the first primary pivot axis 1*a* and the central drive axis 9, is smaller than 50% of the height H. Likewise, in said intermediate pivoted position of the cutting units 10*a*, 10*b*, a distance D' between the second primary pivot axis 1*b* and the skin contact surface of the second shaving track 11*b*, in particular measured in a central imaginary plane comprising the second primary pivot axis 1*b* and the central drive axis 9, is smaller than 50% of the height H.

The movable portion 51 of the central support member 50 is pivotally guided along a curved path 57 relative to the stationary portion 52 of the central support member 50. Seen in the cross-sectional view of the shaving unit in FIG. 3, the curved path 57 comprises a circle segment having a radius and a center point, which defines the position of the secondary pivot axis 3 as a virtual axis. The secondary pivot axis 3 extends perpendicularly to the coinciding primary pivot axes 1*a*, 1*b* and lies approximately in a common plane with the coinciding primary pivot axes 1*a*, 1*b*. Said common plane extends approximately parallel to the skin contact surfaces of the first shaving track 11*a* and the second shaving track 11*b* in an intermediate pivoted position of the cutting units 10*a*, 10*b* between the pivoted positions as shown in FIGS. 1*a* and 1*c*, wherein the first and second shaving tracks 11*a*, 11*b* extend in a common plane. As a result, in said intermediate pivoted position of the cutting units 10*a*, 10*b*, a distance D" between the secondary pivot axis 3 and the skin contact surfaces of the first and second shaving tracks 11*a*, 11*b*, in particular measured in a central imaginary plane comprising the secondary pivot axis 3 and the central drive axis 9, is equal to the distances D, D' between the coinciding primary pivot axes 1*a*, 1*b* and the skin contact surfaces of the first and second shaving tracks 11*a*, 11*b* as shown in FIG. 1*b*, i.e. said distance D" is smaller than 50% of the height H of the housings 20*a*, 20*b* of the cutting units 10*a*, 10*b*. It will be clear that, in embodiments wherein the secondary pivot axis 3 and the primary pivot axes 1*a*, 1*b* do not extend in a common plane, the distance D" may be different from the distances D, D'.

As can be further seen in FIG. 3, two spring elements 23*a*, 23*b* are arranged below the coinciding primary pivot axes 1*a*, 1*b* in the movable portion 51 of the central support member 50. The spring elements 23*a*, 23*b* exert a spring load on the housings 20*a*, 20*b* of the cutting units 10*a*, 10*b* such as to bias the cutting units 10*a*, 10*b* in their concave pivoted positions as shown in FIG. 1*a*, wherein the skin contact surfaces of the shaving tracks 11*a*, 11*b* have a V-shaped geometry. It is to be understood that, in variations of the embodiment of the shaving unit, the spring elements may bias the cutting units 10*a*, 10*b* into different pivoted positions, e.g. into pivoted positions wherein the skin contact surfaces of the shaving tracks 11*a*, 11*b* extend in a common plane and, thus, have a flat geometry, or into pivoted positions wherein the skin contact surfaces of the shaving tracks 11*a*, 11*b* have a convex geometry.

Furthermore, the assembly of the cutting units 10*a*, 10*b* is biased into a neutral pivoted position relative to the secondary pivot axis 3 by a further spring element 23*c*. The further spring element 23*c* is arranged in the stationary portion 52 of the central support member 50 and exerts a biasing force on the movable portion 51 of the central support member 50. Starting from the neutral pivoted position relative to the secondary pivot axis 3 as shown in FIG. 3, the assembly of the cutting units 10*a*, 10*b* may conduct a pivotal movement in a clockwise direction or in an anti-clockwise direction about the secondary pivot axis 3.

FIGS. 5-8 show a shaving unit according to a second embodiment of the invention. This shaving unit comprises three cutting units, i.e. a first cutting unit 110*a*, a second cutting unit 110*b*, and a third cutting unit 110*c*. Each of the three cutting units 110*a*, 110*b*, 110*c* comprises a housing 120*a*, 120*b*, 120*c*, an external cutting member 114*a*, 114*b*, 114*c* with a plurality of hair entry openings which define an annular shaving track 161*a*, 161*b*, 161*c*, and an internal cutting member (not shown in detail in the figures) which is rotatable relative to the external cutting member 114*a*, 114*b*, 114*c* about an axis of rotation 106*a*, 106*b*, 106*c* and which is arranged in the housing 120*a*, 120*b*, 120*c*. The annular shaving tracks 161*a*, 161*b*, 161*c* each have a skin contact surface. The external cutting members 114*a*, 114*b*, 114*c* are each arranged in and held by an annular cover portion 112*a*, 112*b*, 112*c* of, respectively, the housings 120*a*, 120*b*, 120*c*. Each of the cover portions 112*a*, 112*b*, 112*c* also has a skin contact surface surrounding the skin contact surface of the associated shaving track 161*a*, 161*b*, 161*c*. The housings 120*a*, 120*b*, 120*c* each accommodate a hair collecting chamber.

The first cutting unit 110*a* and the second cutting unit 110*b* are pivotal relative to a central support member 150 of the shaving unit about, respectively, a first primary pivot axis 101*a* and a second primary pivot axis 101*b*. Like the first and second primary pivot axes 1*a*, 1*b* in the embodiment of the shaving unit shown in FIGS. 1-4, the first and second primary pivot axes 101*a*, 101*b* are arranged as coinciding first and second primary pivot axes. By means of the first and second primary pivot axes 101*a*, 101*b*, the first and second cutting units 110*a*, 110*b* are pivotal relative to a movable portion 151 of the central support member 150. The coincident first and second primary pivot axes 101*a*, 101*b* are realized by similar hinge structures used to realize the coinciding first and second primary pivot axes 1*a*, 1*b* in the embodiment of FIGS. 3-4.

The third cutting unit 110*c* is pivotal relative to the central support member 150 about a third primary pivot axis 102, which extends perpendicularly to the coinciding first and second pivot axes 101*a*, 101*b*. Seen in a direction parallel to the axis of rotation 106*c* of the third cutting unit 110*c*, the third primary pivot axis 102 is arranged between the shaving track 161*c* of the third cutting unit 110*c* and the axes of rotation 106*a*, 106*b* of the first and second cutting units 110*a*, 110*b*, as is shown in FIG. 6. Seen in the direction parallel to the axis of rotation 106*c* of the third cutting unit 110*c*, the third primary pivot axis 102 is in particular arranged between the external cutting member 114*c* of the third cutting unit 110*c* and the axes of rotation 106*a*, 106*b* of the first and second cutting units 110*a*, 110*b*. However, in alternative embodiments, the third primary pivot axis 102 may be arranged in a position which is not or not fully between the external cutting member 114*c* of the third cutting unit 110*c* and the axes of rotation 106*a*, 106*b* of the first and second cutting units 110*a*, 110*b*, e.g. in a position wherein the third primary pivot axis 102 crosses the external cutting member 114*c* of the third cutting unit 110*c* in a circumferential area thereof. In such alternative embodiments, the third primary pivot axis 102 may still be arranged between the shaving track 161*c* of the third cutting unit 110*c* and the axes of rotation 106*a*, 106*b* of the first and second cutting units 110*a*, 110*b*, i.e. arranged outwardly from the shaving track 161*c* of the third cutting unit 110*c* in a radial direction with respect to the axis of rotation 106*c* of the third cutting unit 110*c* and, consequently, not crossing or covering any of the hair entry openings of the external cutting member 114*c* of the third cutting unit 110*c*, seen in the direction of the axis of rotation 106*c* of the third cutting unit 110*c*.

Figure 7:
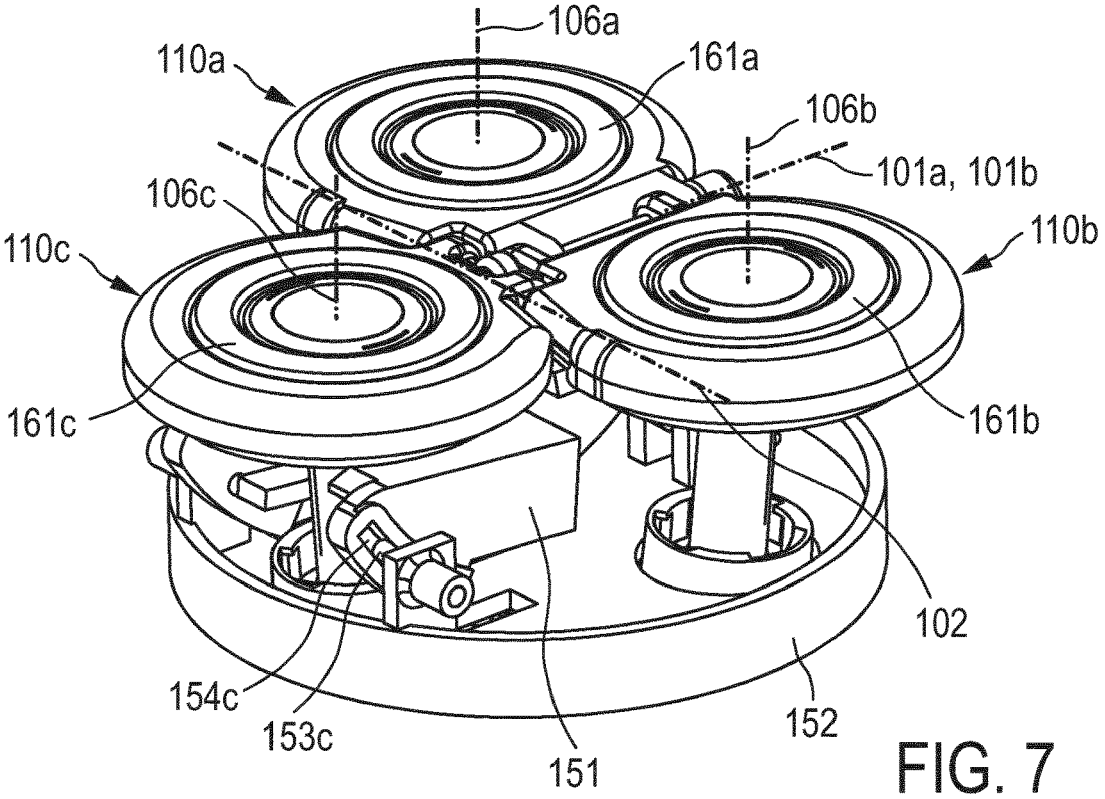
FIG. 7 shows a perspective, partially cut away upper-frontal view of the shaving unit of FIG. 5.
Figure 8:
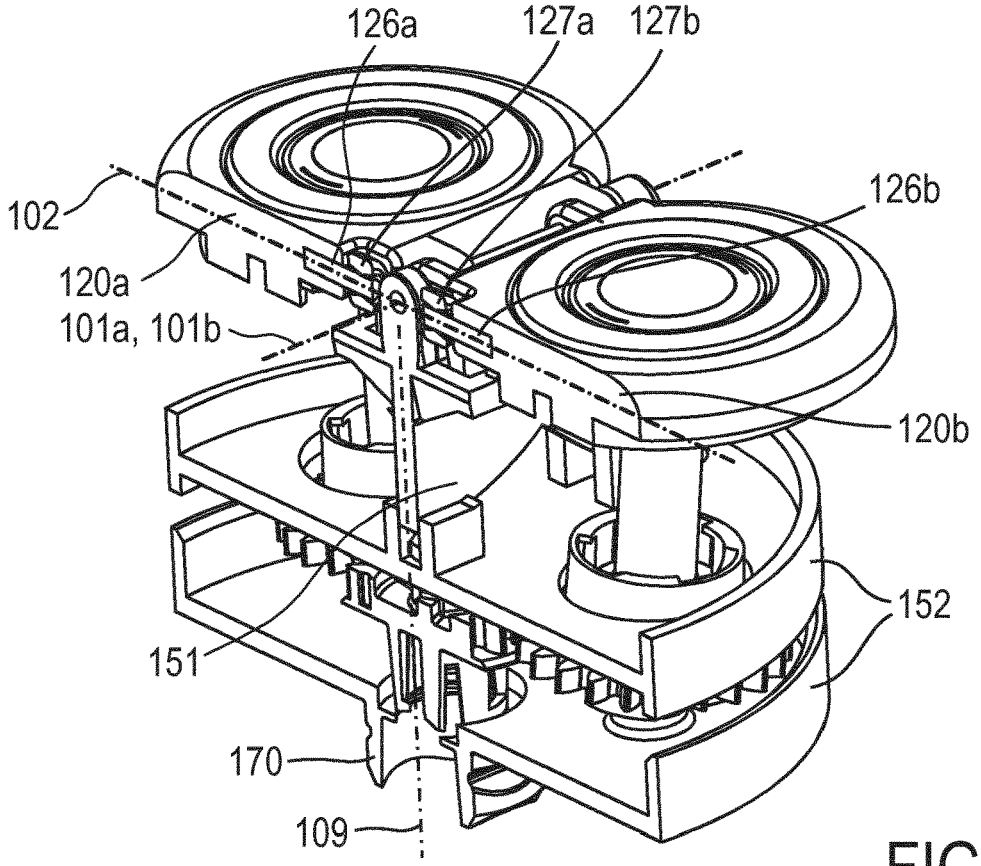
FIG. 8 shows a partial cut away perspective view of the shaving unit as shown in FIG. 7.

In the embodiment of the shaving unit shown in FIGS. 5-8, the housing 120*c* of the third cutting unit 110*c* is pivotally mounted to both the housing 120*a* of the first cutting unit 110*a* and the housing 120*b* of the second cutting unit 110*b*. Thus, the third primary pivot axis 102, about which the third cutting unit 110*c* is pivotal relative to the central support member 150, is a pivot axis about which the third cutting unit 110*c* is pivotal relative to both the central support member 150 and the first and second cutting units 110*a*, 110*b*. The third primary pivot axis 102 is realized by means of a first hinge structure, by means of which the housing 120*c* of the third cutting unit 110*c* is connected to the housing 120*a* of the first cutting unit 110*a*, and by means of a second hinge structure, by means of which the housing 120*c* of the third cutting unit 110*c* is connected to the housing 120*b* of the second cutting unit 110*b*. As shown in detail in FIG. 8, said first hinge structure comprises a bearing pin 126*a*, mounted in a fixed position to the housing 120*a* of the first cutting unit 110*a*, and a bearing bush 127*a* mounted in a fixed position to the housing 120*c* of the third cutting unit 110*c*. Likewise, said second hinge structure comprises a bearing pin 126*b*, mounted in a fixed position to the housing 120*b* of the second cutting unit 110*b*, and a bearing bush 127*b* mounted in a fixed position to the housing 120*c* of the third cutting unit 110*c*. The bearing pins 126*a*, 126*b* engage and are received by, respectively, the bearing bushes 127*a*, 127*b*. The bearing bushes 127*a*, 127*b* are coaxially arranged on the housing 120*c* of the third cutting unit 110*c* and, thereby, define the position of the third primary pivot axis 102 relative to the housing 120*c* of the third cutting unit 110*c*. As shown in FIG. 8, seen in a longitudinal sectional view along the third primary pivot axis 102, the bearing bushes 127*a*, 127*b* each have a non-cylindrical, in particular a convex internal bearing surface which is in contact with the associated bearing pin 126*a*, 126. In other words, the internal bearing surfaces of the bearing bushes 127*a*, 127*b* have a beveled shape towards both their ends, i.e. said internal bearing surfaces have a shape like an hour glass. As a result, the bearing pin 126*a* and the bearing bush 127*a* of the first hinge structure can mutually rotate about an axis parallel to the first primary pivot axis 1*a*. Likewise, the bearing pin 126*b* and the bearing bush 127*b* of the second hinge structure can mutually rotate about an axis parallel to the second primary pivot axis 1*b*. As a result, the first and second hinge structures are adapted to independently follow both a pivotal movement of the housing 120*a* of the first cutting unit 110*a* about the first primary pivot axis 101*a* and a pivotal movement of the housing 120*b* of the second cutting unit 110*b* about the second primary pivot axis 101*b*. Thus, the third cutting unit 110*c* is free to pivot about the third primary pivot axis 102 in any pivotal position of the first and second cutting units 110*a*, 110*b* about the first and second primary pivot axes 101*a*, 101*b*.

Figure 5:
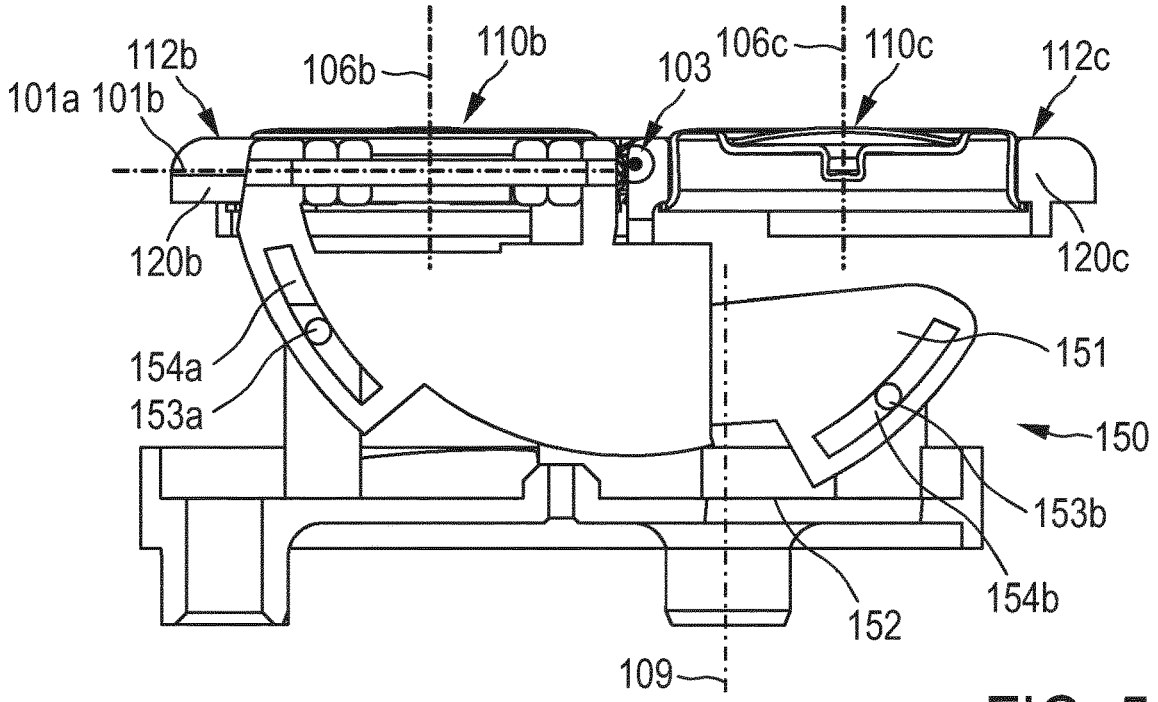
FIG. 5 shows a partially sectioned frontal view of parts of a shaving unit according to a second embodiment of the invention.

As shown in FIGS. 5 and 8, the central support member 150 is arranged below the cutting units 110*a*, 110*b*, 110*c* and comprises the moveable portion 151 and a stationary portion 152. The stationary portion 152 comprises a coupling member 170 by means of which the shaving unit can be releasably coupled to a main housing of a shaving apparatus. The movable portion 151 is pivotal relative to the stationary portion 152 about a secondary pivot axis 103, which extends perpendicularly to the coinciding first and second primary pivot axes 101*a*, 101*b* and parallel to the third primary pivot axis 102, as shown in FIG. 6. The secondary pivot axis 103 is realized by means of a connecting-link-guidance mechanism comprising at least one connecting member guided along a corresponding curved guidance path. In the embodiment shown in FIGS. 5-8, the connecting-link-guidance mechanism comprises a plurality of connecting members in the form of connecting pins 153*a*, 153*b*, 153*c* mounted in fixed positions to the stationary portion 152 of the central support member 150. The connecting pins 153*a*, 153*b*, 153*c* are each guided in a respective curved guidance slot 154*a*, 154*b*, 154*c* provided in a fixed position in the movable section 151 of the central support member 150. The curved guidance slots 154*a*, 154*b*, 154*c* each have a similar radius and coinciding center axes, which form a virtual axis defining the secondary pivot axis 103. By means of said connecting-link-guidance mechanism, the movable portion 151 of the central support member 150, carrying the three cutting units 110*a*, 110*b*, 110*c*, is pivotal relative to the stationary portion 152 of the central support member 150 about the secondary pivot axis 103.

Furthermore, in the embodiment shown in FIGS. 5-8, the coinciding first and second primary pivot axes 101*a*, 101*b*, the third primary pivot axis 102 and the secondary pivot axis 103 each extend parallel to a common plane, in which the skin contact surfaces of the shaving tracks 161*a*, 161*b*, 161*c* of the cutting units 110*a*, 110*b*, 110*c* extend when the cutting units 110*a*, 110*b*, 110*c* are in intermediate pivotal positions, as shown in FIG. 7, wherein the skin contact surfaces of the shaving tracks 161*a*, 161*b*, 161*c* each extend perpendicularly to a central axis 109 of the shaving unit and wherein the axes of rotation 106*a*, 10*b*, 106*c* of the cutting units 110*a*, 110*b*, 110*c* are mutually parallel. As a result of the presence of the first and second primary pivot axes 101*a*, 101*b*, the third primary pivot axis 103, and the secondary pivot axis 103, a twofold pivotal motion is provided for each cutting unit 110*a*, 110*b*, 110*c*, wherein the three cutting units 110*a*, 110*b*, 110*c* can perform a common pivotal movement about the secondary pivot axis 103 and wherein each cutting unit 110*a*, 110*b*, 110*c* can further perform an individual and independent pivotal movement about, respectively, the first, second and third primary pivot axis 101*a*, 101*b*, 102.

Figure 9:
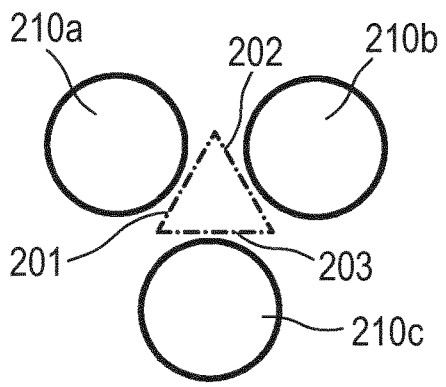
FIG. 9 shows a schematic top view of the arrangement of the primary pivot axes in a third embodiment of the shaving unit according to the invention.

FIG. 9 shows a schematic view of a third embodiment of a shaving unit according to the invention having three cutting units 210*a*, 210*b*, 210*c* and three primary pivot axes 201, 202, 203, i.e. a first primary pivot axis 201 for the first cutting unit 210*a*, a second primary pivot axis 202 for the second cutting unit 210*b* and a third primary pivot axis 203 for the third cutting unit 210*c*. Like the primary pivot axis 1*a*, 1*b*; 101*a*, 101*b*, 102 in the first and second embodiments, the primary pivot axes 201, 202, 203 each constitute a pivot axis about which the cutting units 210*a*, 210*b*, 210*c* are respectively pivotal relative to a central support member of the shaving unit, which is not shown in FIG. 9. In this embodiment, the three primary pivot axes 201, 202, 203 are arranged in a triangular configuration. The first primary pivot axis 201 is arranged between a shaving track (not shown) of the first cutting unit 210*a* and the axes of rotation of the internal cutting members (not shown) of the second and third cutting units 210*b*, 210*c*. Likewise, the second primary pivot axis 202 is arranged between a shaving track (not shown) of the second cutting unit 210*b* and the axes of rotation of the internal cutting members (not shown) of the first and third cutting units 210*a*, 210*c*, and the third primary pivot axis 203 is arranged between a shaving track (not shown) of the third cutting unit 210*c* and the axes of rotation of the internal cutting members (not shown) of the first and second cutting units 210*a*, 210*b*.

Figure 10:
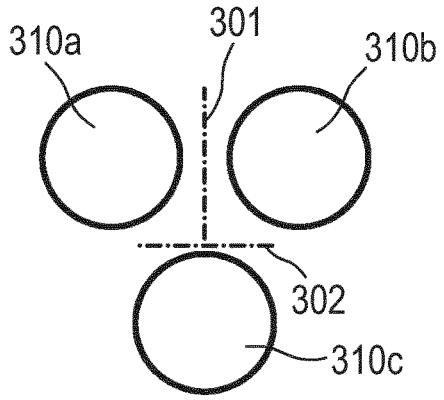
FIG. 10 shows a schematic top view of the arrangement of the primary pivot axes in a fourth embodiment of the shaving unit according to the invention.

FIG. 10 shows a schematic view of a fourth embodiment of a shaving unit according to the invention, having three cutting units 310*a*, 310*b*, 310*c* and having primary pivot axes 301 and 302. In this embodiment, the arrangement of the primary pivot axes 301, 302 is similar to the arrangement of the primary pivot axes 101*a*, 101*b*, 102 in the second embodiment explained beforehand. The first and second cutting units 310*a*, 310*b* have a common primary pivot axis 301, i.e. they have coinciding primary pivot axes about which the cutting units 310*a*, 310*b* can each individually and independently pivot relative to a central support member (not shown) of the shaving unit. The third cutting unit 310*c* has a primary pivot axis 302 about which the third cutting unit 310*c* can pivot relative to the central support member. The primary pivot axis 302 extends perpendicularly to the common primary pivot axis 301 of the first and second cutting units 310*a*, 310*b*. The common primary pivot axis 301 and the primary pivot axis 302 constitute, respectively, a leg and a crossbar of a T-shaped configuration of the primary pivot axes 301, 302.

Figure 11:
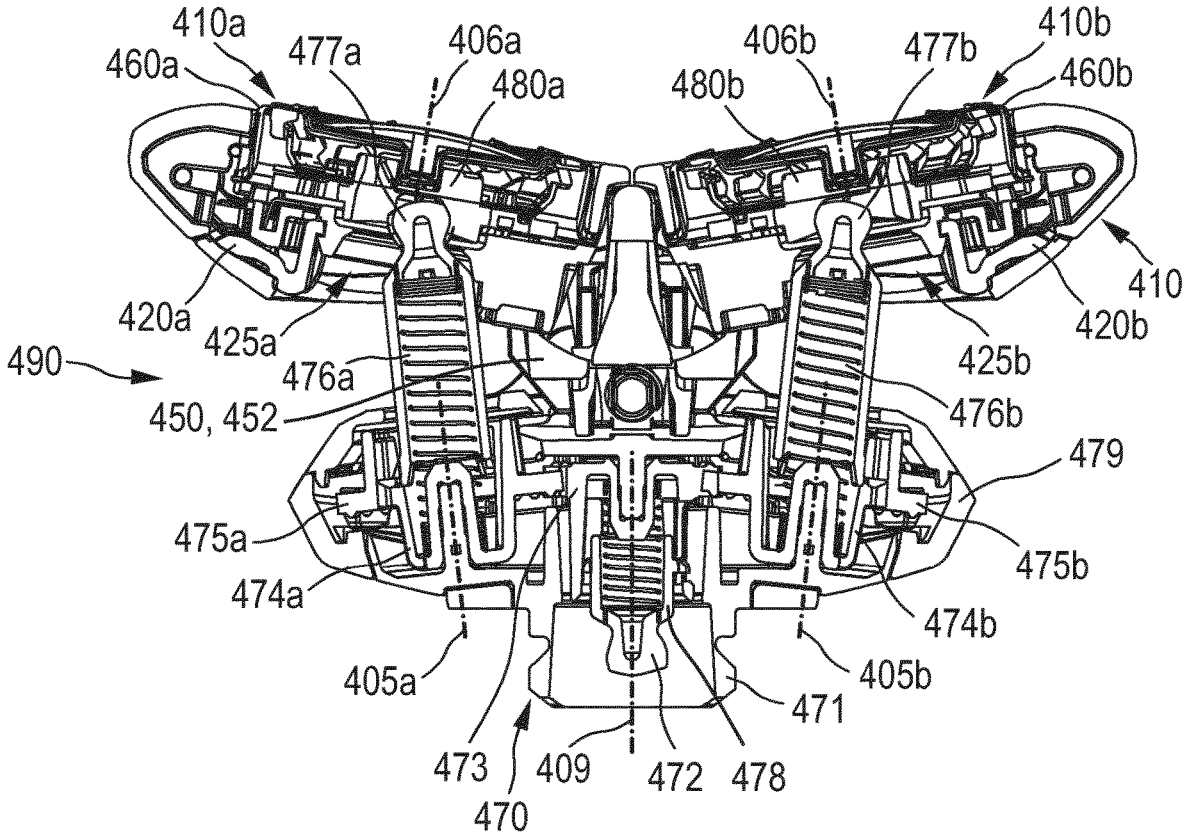
FIG. 11 shows a sectional frontal view of the shaving unit of FIGS. 1*a*-1*c*, depicting a drive train for the cutting units of the shaving unit.
Figure 12:
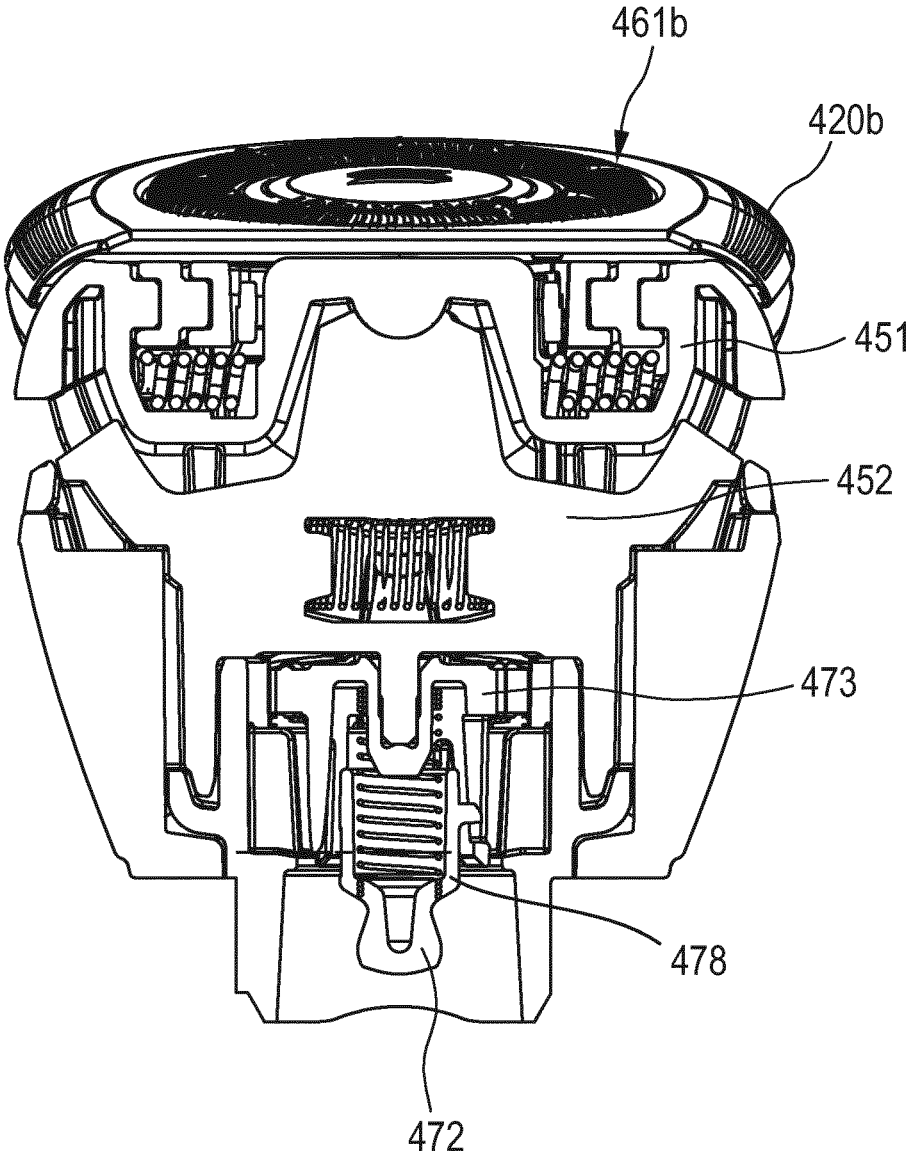
FIG. 12 shows a sectional side view of the shaving unit of FIG. 11.

FIG. 11 shows a sectional frontal view of the shaving unit of FIGS. 1-4 and shows a drive train for the first and second cutting units 410*a*, 410*b* of the shaving unit. The shaving unit as shown in FIG. 11 comprises a coupling member 470 at a bottom side of the shaving unit, by means of which the shaving unit can be releasably coupled to a main housing of a shaving apparatus. At its outer circumference the coupling member 470 comprises a stationary coupling component 471 for releasably mounting the shaving unit to the main housing, i.e. a handle section, of the shaving apparatus. Inside the coupling member 470, a rotatable coupling component 472 is accommodated. The rotatable coupling component 472 is mounted to an end portion of a central drive shaft 478 accommodated in the coupling member 470. The rotatable coupling component 472 is adapted to be coupled to a drive shaft of a drive unit incorporated in said handle section of the shaving apparatus for torque transmission from the drive shaft in the handle section to the central drive shaft 478, when the shaving unit is coupled to the handle section.

The rotatable coupling component 472 and the central drive shaft 478 are parts of the drive train of the shaving unit. The central drive shaft 478 is connected to a central transmission element, embodied as a central gear wheel 473. Said central gear wheel 473 is rotatable about a central transmission axis 409, which corresponds to the main drive axis 9 described beforehand with reference to the embodiment shown in FIGS. 1-4. During operation, with the shaving unit coupled to the handle section of the shaving apparatus, the central gear wheel 473 is driven into rotation about the central transmission axis 409 by the drive unit of the handle section via the rotatable coupling component 472 and the central drive shaft 478.

A first driven transmission element and a second driven transmission element, embodied as, respectively, a first driven gear wheel 475*a* and a second driven gear wheel 475*b*, are arranged to be driven by the central gear wheel 473. The first and second driven gear wheels 475*a*, 475*b* are positioned adjacent to and on opposite sides of the central gear wheel 473 and each engage the central gear wheel 473 for torque transmission. The first driven gear wheel 475*a* and the second driven gear wheel 475*b* are positioned, relative to the central transmission axis 409, radially outwardly from the central gear wheel 473, and are each arranged in a slightly oblique orientation with respect to the central transmission axis 409. Thus, the first driven gear wheel 475*a* is rotatable about a first transmission axis 405*a*, which has a slightly oblique orientation with respect to the central transmission axis 409. Likewise, the second driven gear wheel 475*b* is rotatable about a second transmission axis 405*b*, which also has a slightly oblique orientation with respect to the central transmission axis 409. The first and second transmission axes 405*a*, 405*b* are symmetrically arranged with respect to the central transmission axis 409.

The first and second transmission axes 405*a*, 405*b* and the central transmission axis 409 are each arranged in a stationary position relative to the coupling member 470 and relative to the stationary portion 452 of the central support member 450 of the shaving unit. The central gear wheel 473 and the first and second driven gear wheels 475*a*, 475*b* are accommodated in a transmission housing 479, which is also arranged in a stationary position relative to the coupling member 470 and relative to the stationary portion 452 of the central support member 450 of the shaving unit. The central gear wheel 473 and the first and second driven gear wheels 475*a*, 475*b* are arranged as a transmission unit, accommodated in the transmission housing 479, between the coupling member 470 and the first and second cutting units 410*a*, 410*b*. Between the transmission housing 479 and the first and second cutting units 410*a*, 410*b*, an open space 490 is present which surrounds the central support member 450 as shown in FIG. 11. The open space 490 between the transmission housing 479 and the first and second cutting units 410*a*, 410 is generally open and, thereby, accessible from any radial direction with respect to the central transmission axis 409. The transmission housing 479 is thus arranged between the coupling member 470 and the open space 490.

The internal cutting member 480*a* of the first cutting unit 410*a* is connected to the first driven gear wheel 475*a* by means of a first drive spindle 476*a*, and the internal cutting member 480*b* of the second cutting unit 410*b* is connected to the second driven gear wheel 475*b* by means of a second drive spindle 476*b*. The first drive spindle 476*a* extends from the transmission unit in the transmission housing 479 to the internal cutting member 480*a* of the first cutting unit 410*a* via the open space 490 and through the opening 425*a* in the bottom wall of the housing 420*a* of the first cutting unit 410*a*. Likewise, the second drive spindle 476*b* extends from the transmission unit in the transmission housing 479 to the internal cutting member 480*b* of the second cutting unit 410*b* via the open space 490 and through the opening 425*b* in the bottom wall of the housing 420*b* of the second cutting unit 410. The openings 425*a*, 425*b* in the bottom walls of the housings 420*a*, 420*b* of the first and second cutting units 410*a*, 410*b* shown in FIG. 11 correspond to the openings 25*a*, 25*b* in the bottom walls of the housings 20*a*, 20*b* of the first and second cutting units shown in FIG. 4.

The first and second driven gear wheels 475*a*, 475*b* are circumferentially provided and integrally formed on, respectively, a first cup-shaped rotatable carrier 474*a* and a second cup-shaped rotatable carrier 474*b*. A lower end portion of the first drive spindle 476*a* engages the first rotatable carrier 474*a*, and a lower end portion of the second drive spindle 476*b* engages the second rotatable carrier 474*b*. The lower end portions of the first and second drive spindles 476*a*, 476*b* are configured in such a manner that the drive spindles 476*a*, 476*b* can slide in the two opposite directions parallel to, respectively, the first transmission axis 405*a* and the second transmission axes 405*b* inside, respectively, the first cup-shaped rotatable carrier 474*a* and the second cup-shaped rotatable carrier 474*b*. A mechanical spring is arranged in each of the first and second drive spindles 476*a*, 476*b*, as shown in FIG. 11. The first drive spindle 476*a* is displaceable towards the first driven gear wheel 475*a* against a spring force of the associated mechanical spring in a direction parallel to a spindle axis of the first drive spindle 476*a*, which generally extends substantially or nearly parallel to the first transmission axis 405*a*. Likewise, the second drive spindle 476*b* is displaceable towards the second driven gear wheel 475*b* against a spring force of the associated mechanical spring in a direction parallel to a spindle axis of the second drive spindle 476*b*, which generally extends substantially or nearly parallel to the second transmission axis 405*b*.

Furthermore, the lower end portions of the first and second drive spindles 476*a*, 476*b* are configured in such a manner that the drive spindles 476*a*, 476*b* can pivot relative to, respectively, the first driven gear wheel 475*a* and the second driven gear wheel 475*b* to a limited extent about any axis perpendicular to, respectively, the first transmission axis 405*a* and the second transmission axes 405*b*. Finally, the lower end portions of the first and second drive spindles 476*a*, 476*b* are configured in such a manner that the first and second cup-shaped rotatable carriers 474*a*, 474*b* can transmit a driving torque to, respectively, the first drive spindle 476*a* and the second spindle 476*b* by engagement with the lower end portions thereof.

As further shown in FIG. 11, coupling elements 477*a*, 477*b* are provided on an upper end portion of, respectively, the first drive spindle 476*a* and the second drive spindle 476*b*. The coupling elements 477*a*, 477*b* couple the first and second drive spindles 476*a*, 476*b* with, respectively, the internal cutting member 480*a* of the first cutting unit 410*a* and the internal cutting member 480*b* of the second cutting unit 410*b*. The coupling elements 477*a*, 477*b* are configured in such a manner that the first and second drive spindles 476*a*, 476*b* can transmit a driving torque to, respectively, the internal cutting member 480*a* of the first cutting unit 410*a* and the internal cutting member 480*b* of the second cutting unit 410*b*. Thus, the first and second drive spindles 476*a*, 476*b* are able to transmit a rotational movement from the first and second driven gear wheels 475*a*, 475*b* via the coupling elements 477*a*, 477*b* to the internal cutting members 480*a*, 480*b* of the first and second cutting units 410*a*, 410*b*, respectively. Furthermore, the coupling elements 477*a*, 477*b* are configured in such a manner that the first and second drive spindles 476*a*, 476*b* can pivot to a limited extent relative to, respectively, the internal cutting member 480*a* of the first cutting unit 410*a* and the internal cutting member 480*b* of the second cutting unit 410*b* about any axis perpendicular to, respectively, the first transmission axis 405*a* and the second transmission axes 405*b*. This can e.g. be achieved by a triangular cross-sectional geometry of the coupling elements 477*a*, 477*b* and by providing each internal cutting member 480*a*, 480*b* with a coupling cavity having a corresponding geometry for receiving the associated coupling element 477*a*, 477*b*, as is well known to the person skilled in the art. It is to be understood that the coupling elements 477*a*, 477*b* correspond with the coupling elements 41*a*, 41*b* of the shaving unit shown in FIG. 4.

During operation, the internal cutting members 480*a*, 480*b* of the first and second cutting units 410*a*, 410*b* are driven into a rotational movement about the first and second axes of rotation 406*a*, 406*b* relative to the external cutting members 460*a*, 460*b* of the first and second cutting units 410*a*, 410*b* by the first and second drive spindles 476*a*, 476*b*, respectively. As described here before, the first and second drive spindles 476*a*, 476*b* are displaceable against a spring force in directions parallel to their spindle axes relative to, respectively, the first and second driven gear wheels 475*a*, 475*b*. Furthermore, as described here before, the first and second drive spindles 476*a*, 476*b* are pivotally arranged relative to, respectively, the first and second driven gear wheels 475*a*, 475*b* and relative to the internal cutting member 480*a*, 480*b* of, respectively, the first and second cutting units 410*a*. As a result, the first and second drive spindles 476*a*, 476*b* can follow pivotal movements of the first and second cutting units 410*a*, 410*b* about their primary pivot axis 1*a*, 1*b* as described with respect to the embodiment of the shaving unit of FIGS. 1-4. The mechanical springs arranged in the drive spindles 476*a*, 476*b* bias the drive spindles 476*a*, 476*b* towards the internal cutting members 480*a*, 480*b* and thus maintain a permanent contact and engagement between the coupling elements 477*a*, 477*b* and the internal cutting members 480*a*, 480*b* in any pivotal position of the first and second cutting units 410*a*, 410*b* about the primary pivot axes 1*a*, 1*b* and in any angular orientation of the first and second axis of rotation 406*a*, 406*b* relative to, respectively, the first and second transmission axis 405*a*, 405*b*.

In the embodiment of the shaving unit shown in FIGS. 1-4 and in FIG. 11, the spindle axes of the first and second drive spindles 476*a*, 476*b* and the secondary pivot axis 3 extend in a common imaginary plane, as can best be seen in FIG. 4. As a result, during pivotal movements of the first and second cutting units 410*a*, 410*b* about the secondary pivot axis 3, the drive spindles 476*a*, 476*b* will remain in said common imaginary plane and their positions in said common imaginary plane do not substantially change. This will particularly be the case when the secondary pivot axis 3 extends through the coupling elements 477*a*, 477*b* of the drive spindles 476*a*, 476*b*. In alternative embodiments wherein the spindle axes of the first and second drive spindles 476*a*, 476*b* and the secondary pivot axis 3 do not extend in a common imaginary plane, the layout of the drive spindles 476*a*, 476*b* and the coupling elements 477*a*, 477*b* as described here before will allow the drive spindles 476*a*, 476*b* to also follow pivotal movements of the first and second cutting units 410*a*, 410*b* about the secondary pivot axis 3 as described with respect to the embodiment of the shaving unit of FIGS. 1-4, as well as combined pivotal movements of the first and second cutting units 410*a*, 410*b* about both their primary pivot axes 1*a*, 1*b* and the secondary pivot axis 3.

It is to be understood that, in embodiments of a shaving unit comprising three cutting units as e.g. shown in FIGS. 5-8, the internal cutting member of the third cutting unit may be connected to the transmission unit by means of a third drive spindle extending from the transmission unit to said internal cutting member via the open space and through an opening in a bottom wall of the housing of the third cutting unit. In such embodiments, the third drive spindle may have a similar layout as the first and second drive spindles 476*a*, 476*b* in the embodiment of the shaving unit shown in FIG. 11. It will be clear that, in such embodiments, the transmission unit may comprise a third driven transmission element, e.g. a third driven gear wheel, arranged to be driven by the central gear wheel of the transmission unit in a manner similar to the first and second driven gear wheels 475*a*, 475*b* in the embodiment of the shaving unit shown in FIG. 11. In such embodiments, the internal cutting member of the third cutting unit is connected to said third driven gear wheel via the third drive spindle.

Figure 13:
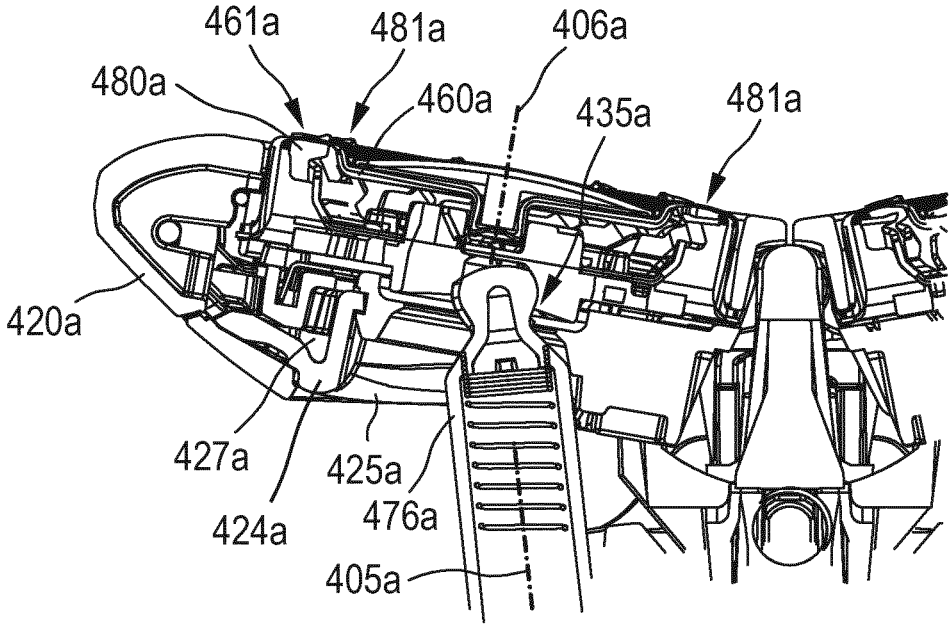
FIG. 13 shows a detailed view of a cutting unit and part of the drive train in the shaving unit of FIG. 11.
Figure 14:
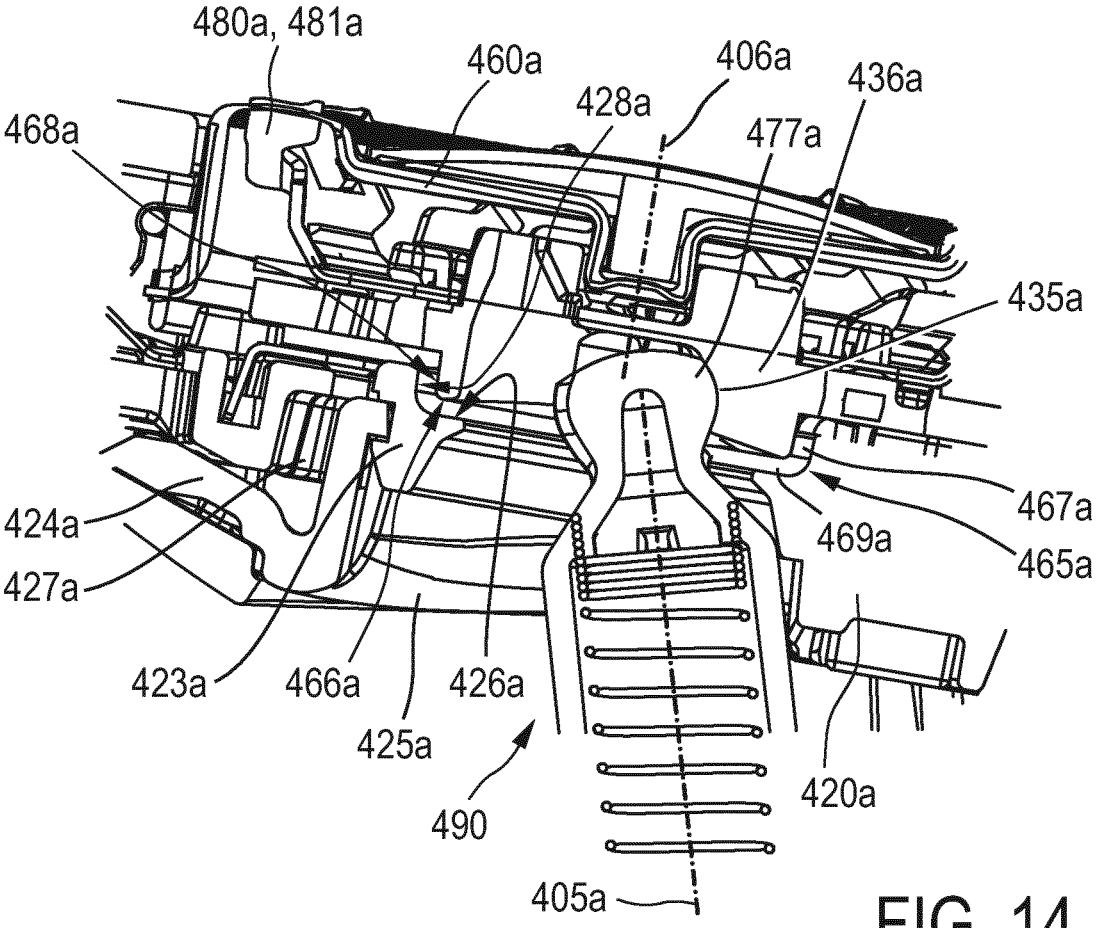
FIG. 14 shows a further detailed view of the shaving unit as shown in FIG. 13.

FIGS. 13 and 14 are detailed views of the first cutting unit 410*a* of the shaving unit of FIG. 11. In the following, further structural elements of the first cutting unit 410*a* of the shaving unit of FIG. 11 will be described with reference to FIGS. 13 and 14. It is to be understood that the second cutting unit 410*b* of the shaving unit of FIG. 11 has similar structural elements. It is further to be understood that also the cutting units of the embodiment of the shaving unit shown in FIGS. 5-10 may have similar structural elements.

FIGS. 13 and 14 show the internal cutting member 480*a* in a position in the housing 420*a* below the external cutting member 460*a*. The external cutting member 460*a* has a plurality of hair entry openings which define the shaving track 461*a* along which, during operation, hair-cutting actions will take place by interaction between the external cutting member 460*a* and the internal cutting member 480*a* rotating relative to the external cutting member 460*a* about the axis of rotation 406*a*. Any cut hairs will be received by and collected in the hair collecting chamber 427*a* which is accommodated in the housing 420*a*. FIGS. 13 and 14 further show in detail the first drive spindle 476*a* which extends through the opening 425*a* provided in the bottom wall 424*a* of the housing 420*a*. The opening 425*a* is provided centrally around the axis of rotation 406*a*. The hair collecting chamber 427*a* is annularly arranged around the opening 425*a* and around the axis of rotation 406*a*. The coupling element 477*a* of the first drive spindle 476*a* engages a coupling cavity 435*a*, which is centrally provided in a central carrying member 436*a* of the internal cutting member 480*a*. The central carrying member 436*a* carries a plurality of cutting elements 481*a* of the internal cutting member 480*a*.

The opening 425*a* is in fluid communication with the hair collecting chamber 427*a*. As a result, the hair collecting chamber 427*a* can be cleaned by providing a flow of a cleaning liquid, e.g. water, via the opening 425*a* into the hair collecting chamber 427*a*. Such a flow of e.g. water can be easily provided to the opening 425*a* via the open space 490 which is present between the transmission housing 479 and the cutting units 410*a*, 410*b*. To prevent cut hairs and other shaving debris from escaping from the hair collecting chamber 427*a* via the opening 425*a* into the open space 490 during normal use of the shaving unit, a sealing structure 465*a* is provided in the flow path between the opening 425*a* and the hair collecting chamber 427*a*. The sealing structure 465*a* is configured and arranged to prevent cut hairs from escaping from the hair collecting chamber 427*a* via the opening 425*a*, but to allow a cleaning liquid, in particular water, to flow or flush via the opening 425*a* into the hair collecting chamber 427*a*. An embodiment of the sealing structure 465*a* will be described in the following. It is to be understood that the second cutting unit 410*b* has a similar sealing structure.

As shown in detail in FIG. 14, the sealing structure 465*a* comprises opposed sealing surfaces 426*a*, 428*a* and 466*a*, 468*a*. The sealing surfaces 426*a*, 428*a* are provided on the housing 420*a*, in particular on an edge structure 423*a* which is provided in the bottom wall 424*a* around the opening 425*a*. The sealing surfaces 466*a*, 468*a* are provided on the internal cutting member 480*a*, in particular on the central carrying member 436*a* of the internal cutting member 480*a*. The opposed sealing surfaces 426*a*, 428*a* and 466*a*, 468*a* are rotationally symmetrical relative to the axis of rotation 406*a*. As a result, the sealing structure 465*a* is rotationally symmetrical relative to the axis of rotation 406*a*.

In particular, the sealing structure 465*a* comprises a first sealing gap 467*a*, which is rotationally symmetrical relative to the axis of rotation 406*a* and has a main direction of extension parallel to the axis of rotation 406*a*. The first sealing gap 467*a* is bounded by a first sealing surface 468*a* of said opposed sealing surfaces, which is provided on the central carrying member 436*a* of the internal cutting member 480*a*, and by a second sealing surface 428*a* of said opposed sealing surfaces, which is provided on the edge structure 423*a* in the bottom wall 424*a* of the housing 420*a*. The first and second sealing surfaces 468*a*, 428*a* are each rotationally symmetrical relative to the axis of rotation 406*a* and each have a main direction of extension parallel to the axis of rotation 406*a*. In particular, the first and second sealing surfaces 468*a*, 428*a* and the first sealing gap 467*a*, bounded by the first and second sealing surfaces 468*a*, 428*a*, are each annular.

Further, the sealing structure 465*a* comprises a second sealing gap 469*a*, which is rotationally symmetrical relative to the axis of rotation 406*a* and has a main direction of extension perpendicular to the axis of rotation 406*a*. The second sealing gap 469*a* is bounded by a third sealing surface 466*a* of said opposed sealing surfaces, which is provided on the central carrying member 436*a* of the internal cutting member 480*a*, and by a fourth sealing surface 426*a* of said opposed sealing surfaces, which is provided on the edge structure 423*a* in the bottom wall 424*a* of the housing 420*a*. The third and fourth sealing surfaces 466*a*, 426*a* are each rotationally symmetrical relative to the axis of rotation 406*a* and each have a main direction of extension perpendicular to the axis of rotation 406*a*. In particular, the third and fourth sealing surfaces 466*a*, 426*a* and the second sealing gap 469*a*, bounded by the third and fourth sealing surfaces 466*a*, 426*a*, are each annular.

Seen in a cross-sectional view along the axis of rotation 406*a*, the axially oriented first sealing gap 467*a* and the radially oriented second sealing gap 469*a* together provide the sealing structure 465*a* with an L-shaped gap structure provided between the edge structure 423*a* and the central carrying member 436*a*, which is rotatable relative to the edge structure 423*a* about the axis of rotation 406*a*. In order to achieve an effective preventing of cut hairs from escaping from the hair collecting chamber 427*a* via the sealing structure 465*a* during a shaving procedure, while allowing an effective flow of water from the opening 425*a* via the sealing structure 465*a* into the hair collecting chamber 427*a*, a minimum distance between the first sealing surface 468*a* and the second sealing surface 428*a*, measured in a direction perpendicular to the axis of rotation 406*a*, is preferably in a range between 0.1 mm and 1.5 mm. For similar reasons, a minimum distance between the third sealing surface 466*a* and the fourth sealing surface 426*a*, measured in a direction parallel to the axis of rotation 406*a*, is preferably in a range between 0.1 mm and 1.5 mm. To further improve the sealing function of the sealing structure 465*a*, the first and second sealing gaps 467*a*, 469*a* may each converge, seen in a direction of the water flow from the central opening 425*a* to the hair collecting chamber 427*a*.

Figure 15:
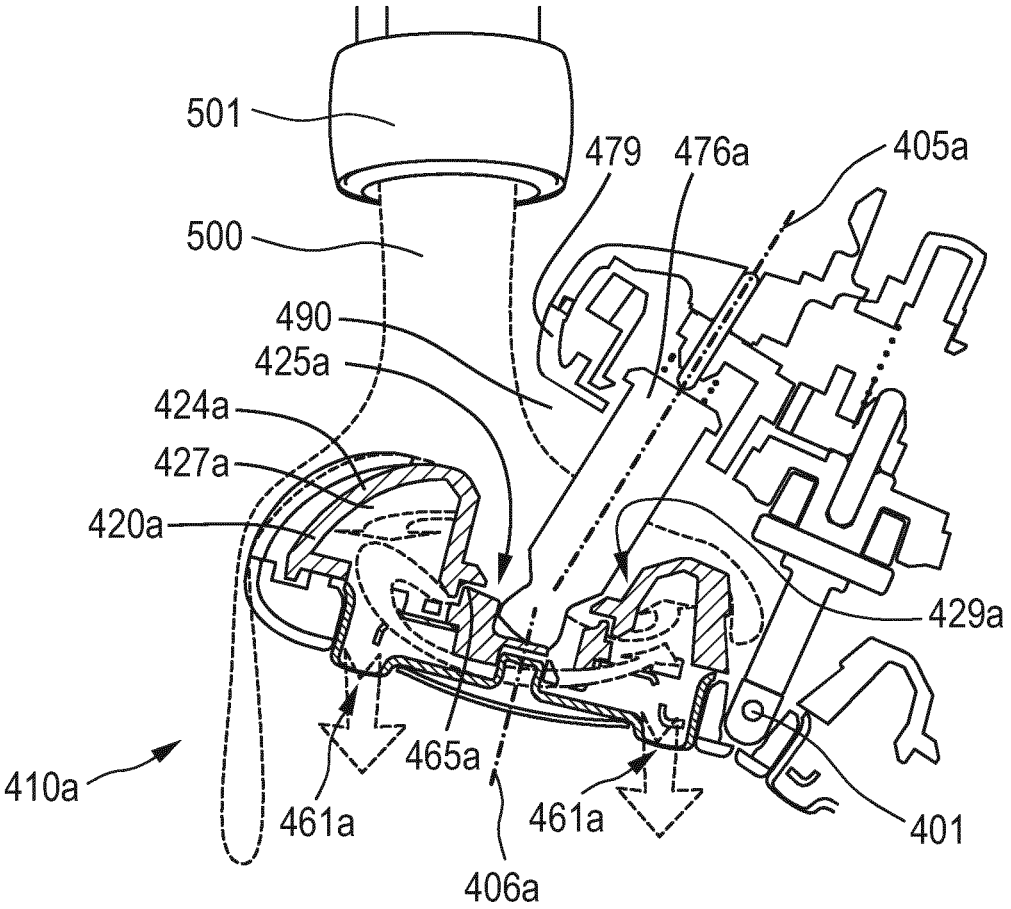
FIG. 15 shows a partial cross-sectional view of a detail of the shaving unit as shown in FIGS. 13 and 14 illustrating a flushing procedure of a cutting unit of the shaving unit.

FIG. 15 shows a flushing procedure to clean the hair collecting chamber 427*a* of the first cutting unit 410*a*. In FIG. 15 the shaving unit is shown in an upside-down position to facilitate a flow of water via the open space 490 into the opening 425*a* in the bottom wall 424*a* of the housing 420*a*. As illustrated in FIG. 15, in said upside-down position of the shaving unit the open space 490 allows a flow of water 500, e.g. from a water tap 501, to directly enter the cutting unit 410*a* via the opening 425*a*. This can be simply realized by directing a stream of water 500 from the tap 501 via the open space 490 onto the bottom wall 424*a* of the cutting unit 410*a*. The flushing water is directed into the opening 425*a* by a funnel 429*a*, provided in the bottom wall 424*a* of the housing 420*a*, and passes into the hair collecting chamber 427*a* via the L-shaped sealing structure 465*a*, which is provided in the flow path between the opening 425*a* and the hair collecting chamber 427*a*. As indicated in FIG. 15 by broken arrows which show the flow of water through the cutting unit 410*a*, the hair collecting chamber 427*a* is flushed by the flow of water. Under the influence of both the gravity force and the hydraulic pressure of the flow of water, the flow of water is forced to leave the hair collecting chamber 427*a* via the plurality of hair entry openings provided in the shaving track 461*a* of the external cutting member 460*a*. This is indicated by two broken arrows pointing in downward direction in FIG. 15. The flow of water will take up and carry cut hairs and other shaving debris collected in the collecting chamber 427*a*. As a result, the cut hairs and other shaving debris are removed from the hair collecting chamber 427*a* by the flow of water leaving the hair collecting chamber 427*a* via the hair entry openings in the shaving track 461*a*. Thus, the hair collecting chamber 427*a* can be cleaned in a simple and efficient way by flushing the cutting unit 410*a* by means of a flow of water supplied via the open space 490 and via the opening 425*a* into the hair collecting chamber 427*a*. It is clear for the skilled person that the second cutting unit 410*b* can be cleaned in a similar way, preferably together with the first cutting unit 410*a*.

FIGS. 16, 17 and 18*a*-18*b* are detailed views of the first cutting unit 410*a* of the shaving unit of FIG. 11. In the following, further structural elements of the first cutting unit 410*a* of the shaving unit of FIG. 11 will be described with reference to FIGS. 16, 17 and 18*a*-18*b*. It is to be understood that the second cutting unit 410*b* of the shaving unit of FIG. 11 has similar structural elements. It is further to be understood that also the cutting units of the embodiment of the shaving unit shown in FIGS. 5-10 may have similar structural elements.

Figure 18A:
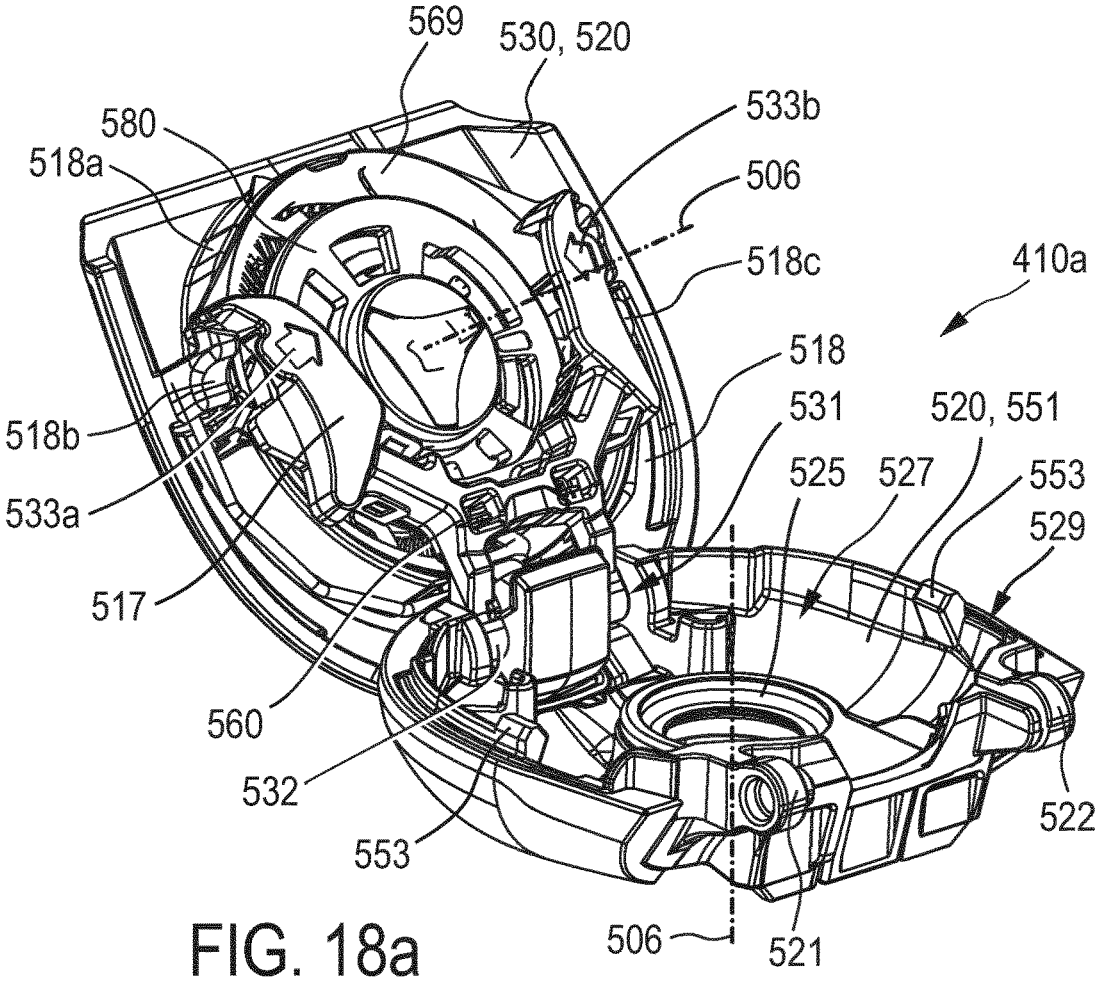
FIGS. 18*a* and 18*b* show a perspective view from an upper frontal side of a housing of the shaving unit of FIG. 11.

As shown in FIG. 18*a*, the housing 520 of the first cutting unit 410*a* comprises a base portion 551 and a cover portion 530. The cover portion 530 is releasably coupled to the base portion 551. In the embodiment shown in FIG. 18*a*, the cover portion 530 is pivotally coupled to the base portion 551 by means of a first hinge mechanism 531. By pivoting the cover portion 530 relative to the base portion 551, the housing 520 can be brought from an opened condition, as shown in FIG. 18*a*, to a closed condition, as e.g. shown in FIG. 11. In the closed condition of the housing 520, the cover portion 530 rests on a circumferential rim portion 529 of the base portion 551 and is releasably coupled to the base portion 551. For this purpose, the housing 520 may comprise any suitable releasable coupling mechanism, such as e.g. snapping elements 553 as shown in FIG. 18*a*. In the closed condition of the housing 520, the hair collecting chamber 527 provided in the base portion 551 is closed and not accessible for a user. In the opened condition of the housing 520, the cover portion 530 is released from the snapping elements 553 and, thereby, released and removed from the base portion 551, except for the permanent connection with the base portion 551 via the first hinge mechanism 531. In the opened condition of the housing 520, the hair collecting chamber 527 is accessible for the user. In alternative embodiments, the cover portion 530 may be completely removable from the base portion 551. In such alternative embodiments, a hinge mechanism connecting the cover portion 530 to the base portion 551 may not be present.

Figure 16:
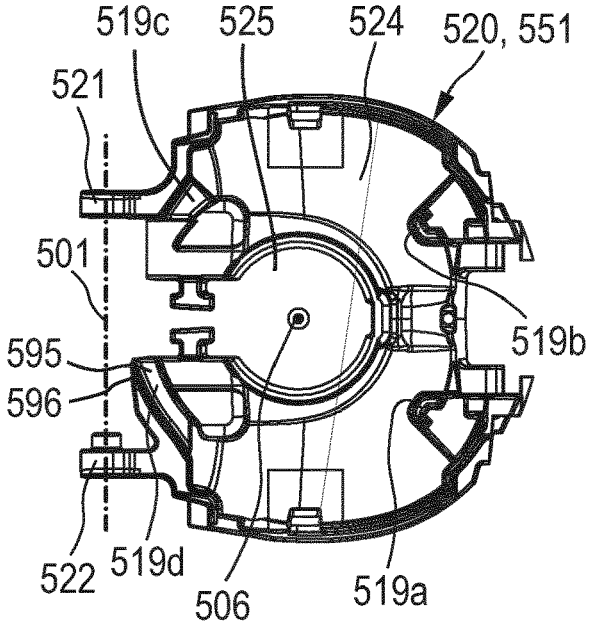
FIG. 16 shows a top view onto a part of a housing of a cutting unit incorporated in the shaving unit of FIG. 11.

FIG. 16 shows a top view onto the base portion 551 of the housing 520. As shown in FIGS. 16 and 18*a*, first and second hinge elements 521, 522 are integrally formed on the base portion 551. The first and second hinge elements 521, 522 correspond with, respectively, the first hinge element 21*a* and the third hinge element 22*a* of the first cutting unit 21*a* in the shaving unit as shown in FIG. 4. The first and second hinge elements 521, 522 define the primary pivot axis 501 about which the cutting unit is pivotal relative to the central support member of the shaving unit. The base portion 551 is thus connected to the central support member of the shaving unit by means of a pivot structure comprising the first and second hinge elements 521, 522. FIGS. 16 and 18*a* further show that the base portion 551 comprises the bottom wall 524 of the housing 520, and that the opening 525 is provided in the bottom wall 524 in a central position around the axis of rotation 506.

Figure 18B:
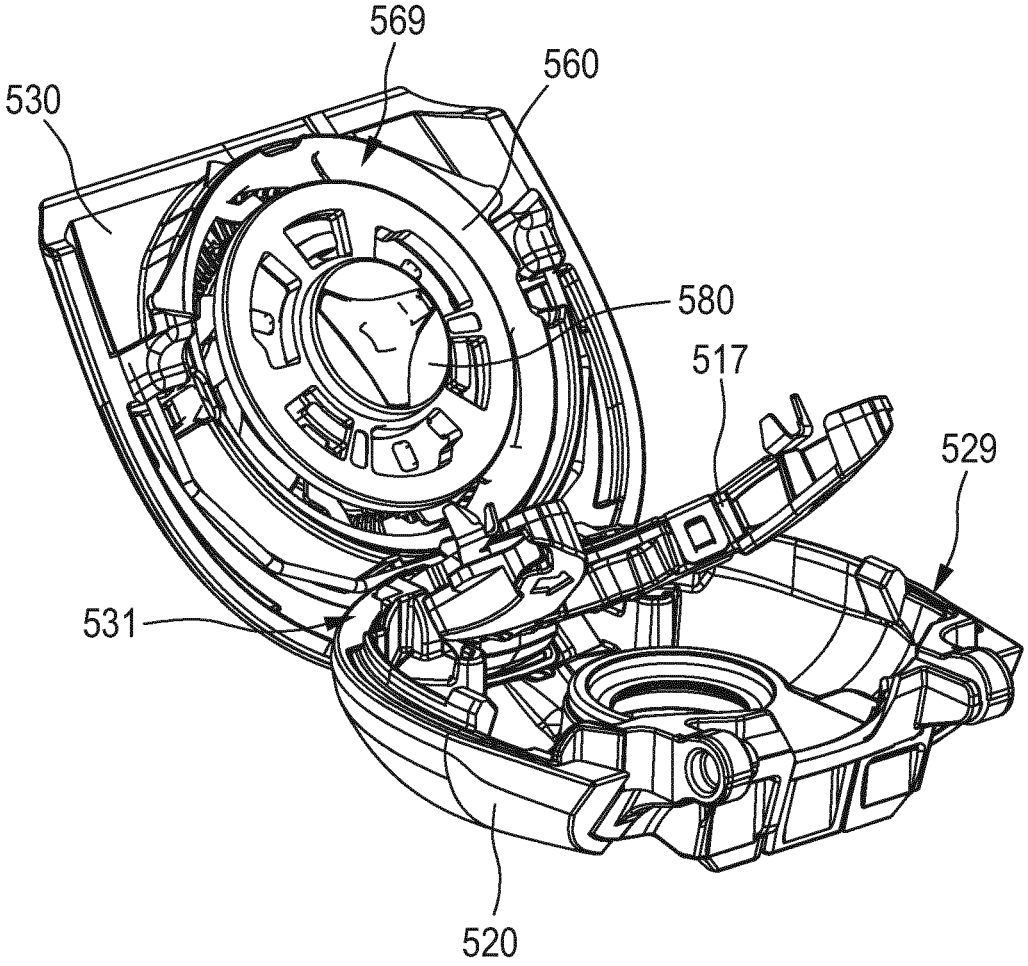

As further shown in FIGS. 18*a* and 18*b*, the cutting unit comprises a holding component 517 which is releasbly coupled to the cover portion 530 of the housing 520. In the embodiment shown in FIGS. 18*a* and 18*b*, the holding component 517 is pivotally coupled to the cover portion 530 by means of a second hinge mechanism 532. The first and second hinge mechanisms 531, 532 may be integrally formed. However, in any embodiments of the first and second hinge mechanisms 531, 532 the holding component 517 should be pivotal relative to the cover portion 530 by means of the second hinge mechanism 532 independently of a pivotal motion of the cover portion 530 relative to the base portion 551 by means of the first hinge mechanism 531. In its position shown in FIG. 18*a*, the holding component 517 is coupled to an inner side of the cover portion 530 by means of a releasable coupling mechanism 533*a*, 533*b*, which may be embodied as a simple snapping mechanism. In this position, the holding component 517 serves to hold the external cutting member 560 and the internal cutting member 580 in an operating position in the cover portion 530. In said operating position, the external cutting member 560 is held in the cover portion 530 by engagement of a circumferential rim 569, provided on a lower side of the external cutting member 560 facing towards the hair collecting chamber 527, with suitable positioning elements (not shown) provided on the inner side of the cover portion 530. The holding component 517 prevents the external cutting member 560 and the internal cutting member 580 from falling out of the cover portion 530 when the housing 520 is opened by pivoting the cover portion 530 relative to the base portion 551. By manually releasing the coupling mechanism 533*a*, 533*b* and pivoting the holding component 517 relative to the cover portion 530 into the position shown in FIG. 18*b*, the external cutting member 560 and the internal cutting member 580 can be simply removed from the cover portion 530, e.g. for cleaning the cutting members 560, 580 separately or for replacing the cutting members 560, 580 by new cutting members. In alternative embodiments, the holding component 517 may be completely removable from the cover portion 530. In such alternative embodiments, a hinge mechanism connecting the holding component 517 to the cover portion 517 may not be present.

As shown in FIG. 16, the base portion 551 of the housing 520 comprises a supporting structure 519*a*, 519*b*, 519*c*, 519*d* for supporting the external cutting member 560 in the closed condition of the housing 520. In the embodiment shown, the supporting structure 519*a*, 519*b*, 519*c*, 519*d* is provided on an inner side of the bottom wall 524 of the base portion 551, and the supporting structure 519*a*, 519*b*, 519*c*, 519*d* is arranged around the central opening 525 in a radial position, relative to the axis of rotation 506, outward of the central opening 525. In the embodiment shown, the supporting structure comprises four supporting elements 519*a*, 519*b*, 519*c*, 519*d* which are arranged with distances between each other around the axis of rotation 506. The supporting elements 519*a*, 519*b*, 519*c*, 519*d* each comprise an abutting surface 595, which extends substantially perpendicularly with respect to the axis of rotation 506 and, in the closed condition of the housing 520, faces towards the external cutting member 560. The abutting surfaces 595 of the supporting elements 519*a*, 519*b*, 519*c*, 519*d* extend in a common plane. In FIG. 16, the abutting surface of only the supporting element 519*b* is indicated by the reference number 595 for simplicity. Preferably, the supporting elements 519*a*, 519*b*, 519*c*, 519*d* are integrally formed at the base portion 551 of the housing 520, e.g. by means of an injection molding process, and preferably they are evenly distributed around the axis of rotation 506. In the embodiment shown, the four supporting elements 519*a*, 519*b*, 519*c*, 519*d* are arranged around the axis of rotation 506 with angular separations of approximately 90° between them. The abutting surfaces 595 of the four supporting elements 519*a*, 519*b*, 519*c*, 519*d* together form an abutment structure for the external cutting member 560 in the closed condition of the housing 520.

Starting from the opened condition of the housing 520 with the external cutting member 560 and the internal cutting member 580 being held in their operating positions in the cover portion 530 by the holding component 517 as shown in FIG. 18*a*, a user has to close the housing 520 by pivoting the cover portion 530 relative to the base portion 551 until the cover portion 530 is coupled to the base portion 551 by means of the snapping elements 553. When the housing 520 is closed in this way and the cover portion 530 is coupled to the base portion 551 by means of the snapping elements 553, the circumferential rim 569 of the external cutting member 560 will abut against the abutting surfaces 595 of the supporting elements 519*a*, 519*b*, 519*c*, 519*d* and will remain in abutting contact with the abutting surfaces 595. As a result, in the closed condition of the housing 520, the external cutting member 560 is directly supported by the abutting surfaces 595 of the supporting elements 519*a*, 519*b*, 519*c*, 519*d* in an axial direction parallel to the axis of rotation 506. As a result, pressure forces, which are exerted on the external cutting member 560 during use mainly in the axial direction parallel to the axis of rotation 506, will be mainly transferred by the external cutting member 560 directly to the supporting structure formed by the supporting elements 519*a*, 519*b*, 519*c*, 519*d* and, thereby, directly to the base portion 551 of the housing 520. As a result, the holding component 517 does not need to receive and transfer said pressure forces, or may need to receive and transfer only a minor portion of said pressure forces. For this reason, the holding component 517 and also the coupling mechanism 533*a*, 533*b*, by means of which is holding component 517 is releasably coupled to the cover portion 530, do not need to have a relatively rigid structure which would be required to receive and transfer said pressure forces. The holding component 517 should only be able to maintain the external cutting member 560 and the internal cutting member 580 in their operating positions in the cover portion 530 when the cover portion 530 is pivoted relative to the base portion 551 to open the housing 520. For this purpose, the holding component 517 and also the coupling mechanism 533*a*, 533*b* only need to have a relatively weak structure. Such a relatively weak structure enables an easy and simple manipulation by the user of the holding component 517 during cleaning or replacing the cutting members 560, 580.

Figure 17:
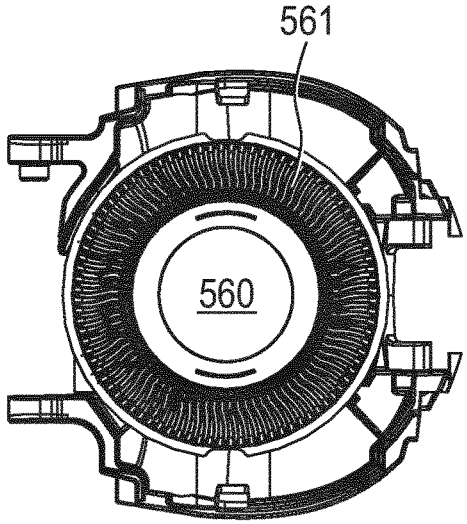
FIG. 17 shows a top view according to FIG. 16 with an external cutting member mounted into the housing.

In particular, in this embodiment the abutment structure formed by the abutting surfaces 595 of the supporting elements 519*a*, 519*b*, 519*c*, 519*d* provides, in the closed condition of the housing 520 and in said axial direction, a form-locking engagement with the external cutting member 560, wherein the external cutting member 560 is locked in the axial direction between the abutting surfaces 595 and the cover portion 530. Preferably, the abutment structure also provides a form-locking engagement with the external cutting member 560 in radial directions perpendicular to the axis of rotation 506. For this purpose, in the embodiment shown in FIG. 16, the supporting elements 519*a*, 519*b*, 519*c*, 519*d* each comprise a further abutting surface 596, which extends in a tangential direction with respect to the axis of rotation 506. In FIG. 16, the further abutting surface of only the supporting element 519*b* is indicated by the reference number 596 for simplicity. The further abutting surfaces 596 of the supporting elements 519*a*, 519*b*, 519*c*, 519*d* have equal distances to the axis of rotation 506. As a result, in the closed condition of the housing 520, the annular circumferential rim 569 of the external cutting member 560 is also held in a radially centered position relative to the axis of rotation 506 by the further abutting surfaces 596. FIG. 17 shows the external cutting member 560 in a position supported by the supporting elements 519*a*, 519*b*, 519*c*, 519*d*, but does not show the cover portion 530.

It is to be understood that a direct support of the external cutting member 560 by the base portion 551 of the housing 520 in the axial direction parallel to the axis of rotation 506 may also be achieved by a supporting structure different from the supporting structure having the four supporting elements 519*a*, 519*b*, 519*c*, 519*d* as described here before. The supporting structure may have a different number of supporting elements, although in embodiments having a plurality of supporting elements at least three supporting elements are preferred for a stable support of the external cutting member. Instead of being provided on the bottom wall 524 of the base portion 551, the supporting structure may alternatively be provided on e.g. a side wall of the base portion 551, e.g. as a supporting surface extending circumferentially around the hair collecting chamber 527. A skilled person will be able to define suitable alternative embodiments wherein the supporting structure is provided in the base portion of the housing such as to support the external cutting member at least in the axial direction parallel to the axis of rotation in the closed condition of the housing of the cutting unit.

The invention further relates to a shaving apparatus comprising a main housing accommodating a motor and comprising a shaving unit as described here before. In particular, the shaving unit is or may be releasably coupled to the main housing by means of the coupling member 70, 170, 470. The main housing accommodating the motor and any further components of such a shaving apparatus, such as a rechargeable battery, user interface, and electrical control circuitry, are not shown in the figures and are not described in any further detail, as they are generally known to a person skilled in the art.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality.

Any reference signs in the claims should not be construed as limiting the scope.

The invention claimed is:

1. A shaving unit for a shaving apparatus, comprising at least a first cutting unit, a second cutting unit and a central support member including a coupling member for releasably coupling the shaving unit to a main housing of the shaving apparatus, wherein:

the first cutting unit comprises a first external cutting member having a plurality of hair entry openings which define a first shaving track, a first internal cutting member which is rotatable relative to the first external cutting member about a first axis of rotation, and a first housing accommodating a first hair collection chamber, the second cutting unit comprises a second external cutting member having a plurality of hair entry openings which define a second shaving track, a second internal cutting member which is rotatable relative to the second external cutting member about a second axis of rotation, and a second housing accommodating a second hair collection chamber, the coupling member accommodates a central drive shaft connected to a central transmission element, the first housing is pivotally mounted to the central support member to pivot about a first primary pivot axis arranged between the first axis of rotation and the second axis of rotation, the second housing is pivotally mounted to the central support member to pivot about a second primary pivot axis arranged between the second axis of rotation and the first axis of rotation, the first internal cutting member is connected to a first driven transmission element via a first drive spindle, the second internal cutting member is connected to a second driven transmission element via a second drive spindle, the first and second driven transmission elements are arranged to be driven by the central transmission element, the central transmission element and the first and second driven transmission elements are arranged as a transmission unit between the coupling member and the first and second cutting units, wherein the first and second drive spindles respectively extend from the transmission unit to the first housing and the second housing via an open space and respectively pass through openings in bottoms walls of the first housing and the second housing, and the open space surrounds the central support member, between the transmission unit and the first and second cutting units, and is external to the shaving apparatus.

2. The shaving unit as claimed in claim 1, wherein the central transmission element is rotatable about a central transmission axis, the first driven transmission element is rotatable about a first transmission axis, and the second driven transmission element is rotatable about a second transmission axis, and wherein the central transmission axis and the first and second transmission axes are arranged in stationary positions relative to the coupling member.

3. The shaving unit as claimed in claim 1, wherein the central transmission element and the first and second driven transmission elements are accommodated in a transmission housing which is arranged in a stationary position relative to the coupling member between the coupling member and the open space.

4. The shaving unit as claimed in claim 1, wherein the central transmission element comprises a central gear wheel and the first and second driven transmission elements each comprises a driven gear wheel.

5. The shaving unit as claimed in claim 1, wherein, seen in a direction parallel to the first axis of rotation, the first primary pivot axis is arranged between the first shaving track and the second axis of rotation, and wherein, seen in a direction parallel to the second axis of rotation, the second primary pivot axis is arranged between the second shaving track and the first axis of rotation.

6. The shaving unit as claimed in claim 5, wherein the first primary pivot axis and the second primary pivot axis coincide.

7. The shaving unit as claimed in claim 1, wherein the central support member comprises a stationary portion and a movable portion, the stationary portion comprising the coupling member, and the movable portion being pivotal relative to the stationary portion about a secondary pivot axis, wherein the first housing is pivotally mounted to the movable portion to pivot about the first primary pivot axis and the second housing is pivotally mounted to the movable portion to pivot about the second primary pivot axis, and wherein the secondary pivot axis is not parallel to the first and second primary pivot axes.

8. The shaving unit as claimed in claim 7, wherein the first housing and the second housing have a height seen in respective directions parallel to the first axis of rotation and parallel to the second axis of rotation, and wherein a distance between the secondary pivot axis and a first skin contact surface comprising the first shaving track and a distance between the secondary pivot axis and a second skin contact surface comprising the second shaving track are less than 50% of said height.

9. The shaving unit as claimed in claim 7, wherein the first and second drive spindles each comprises a spindle axis, wherein the secondary pivot axis and the spindle axes of the first and second drive spindles extend in a common plane, and wherein the first and second primary pivot axes extend perpendicularly to the secondary pivot axis.

10. The shaving unit as claimed in claim 1, wherein the first drive spindle is pivotally arranged relative to the first driven transmission element, and wherein the second drive spindle is pivotally arranged relative to the second driven transmission element.

11. The shaving unit as claimed in claim 1, wherein the first and second drive spindles each comprises a spindle axis, wherein the first drive spindle is displaceable relative to the first driven transmission element in a direction parallel to the spindle axis of the first drive spindle and against a first spring force, and wherein the second drive spindle is displaceable relative to the second driven transmission element in a direction parallel to the spindle axis of the second drive spindle and against a second spring force.

12. The shaving unit as claimed in claim 1, wherein the first drive spindle is pivotally arranged relative to the first internal cutting member, and wherein the second drive spindle is pivotally arranged relative to the second internal cutting member.

13. The shaving unit as claimed in claim 1, wherein the shaving unit comprises a third cutting unit comprising a third external cutting member having a plurality of hair entry openings, a third internal cutting member rotatable relative to the third external cutting member about a third axis of rotation, and a third housing accommodating a third hair collection chamber, wherein:

the third housing is pivotal relative to the central support member about a third primary pivot axis arranged between the third axis of rotation and each of the first and second axes of rotation, the third internal cutting member is connected, via a third drive spindle, to a third driven transmission element of the transmission unit arranged to be driven by the central transmission element, and the third drive spindle extends from the transmission unit via the open space and through an opening in a bottom wall of the third housing.

14. The shaving unit as claimed in claim 13, wherein the first and second primary pivot axes are mutually parallel or coinciding, and that the third housing is connected to the first housing and to the second housing by a first hinge structure and a second hinge structure, respectively, wherein the first and second hinge structures each comprises a bearing pin engaging a bearing bush, and wherein the bearing bush, seen in a longitudinal sectional view along the third primary pivot axis, has a non-cylindrical bearing surface such as to allow mutual rotation of the bearing pin and the bearing bush about an axis parallel to the first and second primary pivot axes.

15. The shaving unit of claim 14, wherein the non-cylindrical bearing is convex.

16. The shaving unit as claimed in claim 1, wherein the first housing and the second housing each comprises, near the openings in the bottom walls, a first sealing structure which is symmetrical relative to the first axis of rotation and the second axis of rotation, respectively, and wherein the first internal cutting member and the second internal cutting member each comprises a second sealing structure, which is symmetrical relative to the first axis of rotation and the second axis of rotation, respectively, and arranged for cooperation with the first sealing structure of the first housing and the second housing, respectively.

17. A shaving apparatus comprising:

a main housing accommodating a motor; and a shaving unit comprising at least a first cutting unit, a second cutting unit and a central support member including a coupling member for releasably coupling the shaving unit to the main housing, wherein:

the first cutting unit comprises a first external cutting member having a plurality of hair entry openings which define a first shaving track, a first internal cutting member which is rotatable relative to the first external cutting member about a first axis of rotation, and a first housing accommodating a first hair collection chamber, the second cutting unit comprises a second external cutting member having a plurality of hair entry openings which define a second shaving track, a second internal cutting member which is rotatable relative to the second external cutting member about a second axis of rotation, and a second housing accommodating a second hair collection chamber, the coupling member accommodates a central drive shaft connected to a central transmission element, the shaving unit is releasably coupled to the main housing by the coupling member, the first housing is pivotally mounted to the central support member to pivot about a first primary pivot axis arranged between the first axis of rotation and the second axis of rotation, the second housing is pivotally mounted to the central support member to pivot about a second primary pivot axis arranged between the second axis of rotation and the first axis of rotation, the first internal cutting member is connected to a first driven transmission element via a first drive spindle, the second internal cutting member is connected to a second driven transmission element via a second drive spindle, the first and second driven transmission elements are arranged to be driven by the central transmission element, the central transmission element and the first and second driven transmission elements are arranged as a transmission unit between the coupling member and the first and second cutting units, wherein the first and second drive spindles respectively extend from the transmission unit to the first housing and the second housing via an open space and respectively pass through openings in bottoms walls of the first housing and the second housing, and the open space surrounds the central support member, between the transmission unit and the first and second cutting units, and is external tO the shaving apparatus.

18. A shaver comprising:

a main housing accommodating a motor having a motor shaft;

a coupler including a central drive shaft releasably coupled to the motor shaft, a transmission including a central transmission gear and a driven gear, the central drive shaft being connected to the central transmission gear, and the driven gear being driven by the central transmission gear;

at least one cutter releasably coupled to the main housing by the coupler and being connected to the driven gear via a drive spindle; and a cutter housing including the at least one cutter, wherein the transmission is between the coupler and the at least one cutter, wherein the drive spindle extends from the transmission to the at least one cutter through a transmission opening of the transmission, passing an open space and through an opening in a bottom wall of the cutter housing, and wherein the open space is between the transmission and the cutter housing and is external to the shaver, wherein the at least one cutter includes a first cutter within a first housing, a second cutter within a second housing and a third cutter within a third housing, wherein the first cutter housing is pivotally mounted to a central support to pivot about a first primary pivot axis, wherein the second cutter housing is pivotally mounted to the central support to pivot about the first primary pivot axis or about a second primary pivot axis, wherein when the second cutter housing is pivotally mounted to the central support to pivot about the first primary pivot axis, the third cutter housing is pivotally mounted to the central support to pivot about the second primary pivot axis, and the first primary pivot axis is perpendicular to the second primary pivot axis, and when the second cutter housing is pivotally mounted to the central support to pivot about the second primary pivot axis, the third cutter housing is pivotally mounted to the central support to pivot about a third primary pivot axis, and the first, second and third primary pivot axes are arranged in a triangular arrangement relative to each other.

* * * * *